US009630192B2

(12) United States Patent
Kusu

(10) Patent No.: US 9,630,192 B2
(45) Date of Patent: Apr. 25, 2017

(54) NOZZLE DEVICE

(71) Applicant: KSK CO. LTD., Aichi (JP)

(72) Inventor: Shinji Kusu, Aichi (JP)

(73) Assignee: KSK CO. LTD., Aichi (JP)

( * ) Notice: Subject to any disclaimer, the term of this patent is extended or adjusted under 35 U.S.C. 154(b) by 0 days.

(21) Appl. No.: 14/912,468

(22) PCT Filed: Aug. 11, 2014

(86) PCT No.: PCT/JP2014/071214
§ 371 (c)(1),
(2) Date: Feb. 17, 2016

(87) PCT Pub. No.: WO2015/025765
PCT Pub. Date: Feb. 26, 2015

(65) Prior Publication Data

US 2016/0199679 A1 Jul. 14, 2016

(30) Foreign Application Priority Data

Aug. 23, 2013 (JP) ..... 2013-173055

(51) Int. Cl.
*B05B 15/00* (2006.01)
*B05B 1/14* (2006.01)
(Continued)

(52) U.S. Cl.
CPC ..... *B05B 1/14* (2013.01); *A62C 31/03* (2013.01); *A62C 31/05* (2013.01); *B05B 3/02* (2013.01);
(Continued)

(58) Field of Classification Search
CPC B05B 1/14; B05B 1/1636; B05B 3/02; B05B 7/0087; B05B 15/066; B05B 15/08; A62C 31/05
(Continued)

(56) References Cited

U.S. PATENT DOCUMENTS 2,364,848 A * 12/1944 Hurst ..... A62C 31/03 239/444

FOREIGN PATENT DOCUMENTS

DE 102005047299 A1 4/2007
DE 102011013534 B3 3/2012
(Continued)

OTHER PUBLICATIONS

International Search Report dated Sep. 22, 2014 for PCT/JP2014/071214.
(Continued)

*Primary Examiner* — Arthur O Hall
*Assistant Examiner* — Viet Le
(74) *Attorney, Agent, or Firm* — Lucas & Mercanti, LLP

(57) ABSTRACT

A nozzle device for spraying fluid includes a body, two or more rotational nozzles, and a control member. The body includes a supply inlet that receives supply of fluid and two or more spray holes that communicate with the supply inlet and are open on a fluid spraying side. The rotational nozzles are arranged in the body in correspondence with the two or more spray holes, the rotational nozzles being retained in the body in a rotatable manner. The control member controls rotation of the rotational nozzles. Each rotational nozzle has a nozzle hole, through which fluid flowing into the corresponding spray hole of the body is sprayed toward a spraying side of the nozzle device. Each rotational nozzle includes a tip portion on the spraying side in which an axis of the nozzle hole is tilted relative to a rotation axis of the rotational nozzle.

12 Claims, 8 Drawing Sheets

(51) Int. Cl.

| | |
|---|---|
| ***B05B 3/02*** | (2006.01) |
| ***A62C 31/05*** | (2006.01) |
| ***B05B 15/08*** | (2006.01) |
| ***A62C 31/03*** | (2006.01) |
| ***B05B 15/06*** | (2006.01) |
| ***B05B 7/00*** | (2006.01) |

(52) U.S. Cl.
CPC ..... *B05B 7/0087* (2013.01); *B05B 15/066* (2013.01); *B05B 15/08* (2013.01)

(58) Field of Classification Search
USPC ..... 239/243, 393, 394, 484
See application file for complete search history.

(56) References Cited

FOREIGN PATENT DOCUMENTS

| | | | | |
|---|---|---|---|---|
| EP | 1894631 | A1 | | 3/2008 |
| JP | 53-126395 | B | | 10/1978 |
| JP | 06-21769 | A | | 3/1994 |
| JP | 07-505575 | A | | 6/1995 |
| JP | 08-243514 | A | | 9/1996 |
| JP | 2001314782 | A | | 11/2001 |
| JP | 2005118761 | A | | 5/2005 |
| JP | 2006346846 | A | | 12/2006 |
| JP | 2009291699 | A | | 12/2009 |
| JP | 2009291871 | A | | 12/2009 |
| JP | 2011125805 | A | | 6/2011 |
| JP | 2011230075 | A | | 11/2011 |
| JP | 2012135460 | A | * | 7/2012 |
| KR | 20110057291 | A | | 6/2011 |

OTHER PUBLICATIONS

Extended European Search Report dated Aug. 16, 2016 from the corresponding European Application; Application No./Patent No. 14838098.3-1760/3037176 PCT/JP2014071214; Applicant: KSK Co., Ltd.; Total of 7 pages.

* cited by examiner

NOZZLE DEVICE

CROSS REFERENCE TO RELATED APPLICATION

This Application is a 371 of PCT/JP2014/071214 filed on Aug. 11, 2014, which, in turn, claimed the priority of Japanese Patent Application No. 2013-173055 filed on Aug. 23, 2013, both applications are incorporated herein by reference.

FIELD

The present invention relates to a nozzle device, and more particularly, to a nozzle device for spraying a fluid that can continuously change the angle at which the fluid is sprayed.

BACKGROUND

Nozzle devices have one main use in fire extinguishing work. To achieve the safety of workers involved in fire extinguishing work, single-hole nozzles, which are suitable for spraying water to distant places, have been used in the fire extinguishing work. A single-hole nozzle can spray water with high compression at its destination and with strong destructive power, and can be used to extinguish fires while displacing obstacles. However, the single-hole nozzle cannot spray water in a wide spray pattern. When the area for extinguishing fires is wide, the orientation of the fire extinguishing nozzle is to be changed as appropriate in the fire extinguishing work. This places a large burden on workers who perform the fire extinguishing work, and extends the time taken to extinguish fires.

Multi-hole nozzles including a plurality of nozzles arranged at different angles have been developed to spray fluids, such as water, to distant places in wide spray patterns.

Japanese Unexamined Patent Application Publication No. 2009-291699 (Patent Literature 1) describes a nozzle device for extinguishing fires including a plurality of nozzle cases. The nozzle device for extinguishing fires described in Patent Literature 1 includes a central nozzle case and a plurality of nozzle cases surrounding the central nozzle case. The surrounding nozzle cases are tilted away from the center nozzle case toward their tips. This nozzle device can easily spray water to a wider area than a single-hole nozzle.

However, the nozzle device for extinguishing fires described in Patent Literature 1 includes the surrounding nozzle cases that are fixed on a nozzle mounting base at fixed spraying angles, and thus cannot change the size of an area into which water is sprayed without changing the positioning for the fire extinguishing work. This has increased the need for multi-hole nozzles that can change their spraying angles.

Japanese Unexamined Patent Application Publication No. 2012-135460 (Patent Literature 2) describes a water-spraying nozzle device for extinguishing fires that can change the tilt angles of the surrounding nozzles included in the multi-hole nozzle (refer to FIG. 5 in Patent Literature 2).

The water-spraying nozzle device for extinguishing fires described in Patent Literature 2 includes a plurality of surrounding nozzles each with a two-part structure including a stationary branch pipe arranged at an angle such that these surrounding nozzles are oriented away from one another toward the spraying side, a movable water spraying pipe, and a joint fitting that joins the movable pipe to a distal end of the stationary branch pipe in a rotatable manner. The tilt angles of the movable water spraying pipes are changed by axially moving angle adjusting shafts, which externally support the movable water spraying pipes, in cooperation with rotation of a ring part included in an angle adjusting mechanism to axially change the positions at which the angle adjusting shafts support the movable water spraying pipes.

CITATION LIST

Patent Literature

Patent Literature 1: Japanese Unexamined Patent Application Publication No. 2009-291699

Patent Literature 2: Japanese Unexamined Patent Application Publication No. 2012-135460

SUMMARY

Technical Problem

However, the water-spraying nozzle device for extinguishing fires described in Patent Literature 2 includes the joint fittings to connect the movable water spraying pipes to the stationary branch pipes in a rotatable manner. This structure is complicated, and can increase cost. To change the angles of the movable water spraying pipes, the angle adjusting shafts, which externally support the movable water spraying pipes, need to be moved axially by rotating the ring part of the angle adjusting mechanism along the screw on the body of the ring part. Patent Literature 2 states the need for strong power to rotate the ring part of the angle adjusting mechanism (refer to paragraph [0018] in Patent Literature 2).

Although the literature does not clearly state the reasons for the structure that needs strong power to rotate the ring part of the angle adjusting mechanism, this seems to be because the water pressure applied on the movable water spraying pipes pushes the angle adjusting mechanism in a direction opposite to the water spraying side, and any structure in which a ring part of an angle adjusting mechanism can be rotated easily may allow such water pressure to rotate the ring part and to change the angles of the movable water spraying pipes.

As described above, the water-spraying nozzle device for extinguishing fires in Patent Literature 2 includes the ring part of the angle adjusting mechanism to be rotated with strong power to change the water spraying angle. Changing the water spraying angle during fire extinguishing work seems to place a large burden on workers involved in the fire extinguishing work.

An object of the present invention is to provide a nozzle device with a simple structure that can easily change the spraying angle.

In response to the above issue, the inventor of the present application has conducted extensive research and arrived at a nozzle device that can easily change the spraying angle with a simple structure including a mechanism for rotating a plurality of nozzles in each of which a nozzle hole formed in a tip portion is tilted relative to the axis of rotation.

A nozzle device according to one aspect of the present invention is a nozzle device for spraying fluid including a body including a supply inlet that receives supply of fluid and two or more spray holes that communicate with the supply inlet and are open on a fluid spraying side, two or more rotational nozzles arranged in the body in correspondence with the two or more spray holes and retained in the body in a rotatable manner, and a control member that controls rotation of the rotational nozzles.

Each rotational nozzle has a nozzle hole, through which fluid flowing into the corresponding spray hole of the body is sprayed toward a spraying side of the nozzle device.

Each rotational nozzle includes a tip portion on the spraying side in which an axis of the nozzle hole is tilted relative to a rotation axis of the rotational nozzle.

The nozzle device further includes a rotation control mechanism that rotates each rotational nozzle based on an operation of the control member, and the rotation control mechanism is arranged between the control member and each rotational nozzle.

In this structure, the control member can be operated to cause the rotation control mechanism to rotate the plurality of rotational nozzles and to change the orientation of the nozzle hole in the tip portion of each rotational nozzle. This changes the direction in which a fluid is sprayed from each of the rotational nozzles.

As the direction in which the fluid is sprayed from each rotational nozzle changes, the relative direction of the fluid sprayed from each rotational nozzle changes accordingly. As a result, the nozzle device can change the angle at which the fluid is sprayed.

The spraying angle is changed by rotating the rotational nozzles, which is achieved by operating the control member. Thus, the spraying angle can be changed using the simple structure.

The pressure of the fluid applied on the nozzle hole of each rotational nozzle acts in the direction to push the rotational nozzle toward the spraying side in the direction of the rotation axis of the rotational nozzle. Thus, almost no such fluid pressure is applied in the direction of rotation of the rotational nozzle, which is substantially perpendicular to the above spraying side direction. Thus, almost no such fluid pressure affects the operation of the control member for rotating the rotational nozzles. Although the pressure of the fluid is high, the spraying angle of the fluid can be changed easily by operating the control member with small power.

In the nozzle device according to the aspect of the present invention, the control member is a tubular rotational ring arranged around an outer circumferential portion of the body in a rotatable manner.

Each rotational nozzle arranged in the body includes a protrusion that is placed through the corresponding spray hole and protrudes on the fluid spraying side.

Each rotational nozzle includes a ring groove on an outer circumferential surface, and the ring groove receives a retainer pin protruding from a wall surface of the corresponding spray hole and extending inside the corresponding spray hole, and the retainer pin is engaged with the ring groove to retain the rotational nozzle in the body in a rotatable manner.

The rotation control mechanism that rotates each rotational nozzle based on an operation to rotate the rotational ring is arranged between an inner circumferential surface of the rotational ring and the protrusion of each rotational nozzle facing the inner circumferential surface.

In this structure, the rotational ring, which is the control member, can be operated and rotated to cause the rotation control mechanism to rotate the plurality of rotational nozzles. As a result, the nozzle device can change the angle at which the fluid is sprayed. The spraying angle is changed by rotating the rotational nozzles, which is achieved by operating and rotating the rotational ring. Thus, the spraying angle can be changed using the simple structure.

In the nozzle device according to the aspect of the present invention, the body includes a body part including the spray holes and the supply inlet, and a lid including a hole through which each rotational nozzle is placed.

The control member is a dial arranged on a spraying side of the body.

Each spray hole includes a tubular side wall and protrudes toward a spraying side of the body part.

Each rotational nozzle is arranged in the body part such that the nozzle hole receives the side wall of the corresponding spray hole.

Each rotational nozzle protrudes from the hole formed in the lid toward the spraying side of the body.

An end of each rotational nozzle on the side of the body is arranged between the lid that is fixed to the body part and the body part to retain the rotational nozzle in the body in a rotatable manner.

The rotation control mechanism that rotates each rotational nozzle based on an operation to rotate the dial is arranged between the dial and a protrusion of each rotational nozzle protruding from the lid.

In this structure, the dial, which is the control member, can be operated and rotated to cause the rotation control mechanism to rotate the plurality of rotational nozzles. As a result, the nozzle device can change the angle at which the fluid is sprayed. The spraying angle is changed by rotating the rotational nozzles, which is achieved by operating and rotating the dial. Thus, the spraying angle can be changed using the simple structure.

In the nozzle device according to the aspect of the present invention, the body includes a body part including the spray holes and the supply inlet, and a lid including a hole through which each rotational nozzle is placed.

The control member is a lever arranged on an outer circumferential portion of the body.

Each rotational nozzle is arranged in the body part such that an end of each rotational nozzle on the side of the body part is placed in the corresponding spray hole.

Each rotational nozzle includes a tip portion protruding from the hole formed in the lid toward the spraying side of the body.

Each rotational nozzle is arranged between the lid that is fixed to the body part and the body part to retain the rotational nozzle in the body in a rotatable manner.

The rotation control mechanism that rotates each rotational nozzle based on an operation to change a direction of the lever is arranged between the lever and each rotational nozzle.

In this structure, the lever, which is the control member, can be operated to change the orientation of the lever to cause the rotation control mechanism to rotate the plurality of rotational nozzles. As a result, the nozzle device can change the angle at which the fluid is sprayed. The spraying angle is changed by rotating the rotational nozzles, which is achieved by operating the lever to change the orientation of the lever. Thus, the spraying angle can be changed using the simple structure.

In the nozzle device according to the aspect of the present invention, each rotational nozzle integrally includes the tip portion, and an axis of the tip portion is identical to the rotation axis of the rotational nozzle, and the nozzle hole in the tip portion is tilted relative to the rotation axis of the rotational nozzle.

In this structure, each rotational nozzle integrally includes the tip portion. The nozzle device thus includes fewer parts. The axis of the tip portion of each rotational nozzle is identical to the rotation axis of the rotational nozzle. In this case, the tip portion of each rotational nozzle does not sway when the control member is operated. The nozzle device is thus easy to handle.

In the nozzle device according to the aspect of the present invention, the nozzle hole of each of all the rotational nozzles is tilted at a fixed angle relative to the rotation axis of each rotational nozzle.

In this structure, the nozzle holes are oriented in the fixed direction. The nozzle holes are thus easy to process.

In the nozzle device according to the aspect of the present invention, each of the rotational nozzles arranged in the body in correspondence with the spray holes has the rotational axis that is parallel to an axis of the nozzle device in a spraying direction or is tilted toward the spraying side of the nozzle device away from a center of the nozzle device on the spraying side.

When the rotation axis of the rotational nozzle is parallel to the axis of the nozzle device in the spraying direction, the spray hole for receiving the rotational nozzle can be formed easily. When the rotation axis of the rotational nozzle is tilted toward the spraying side of the nozzle device relative to the axis of the nozzle device in the spraying direction away from the center of the nozzle device on the spraying side, the fluid can be easily sprayed at a wide spraying angle.

In the nozzle device according to the aspect of the present invention, the rotation control mechanism is configured to rotate each of the rotational nozzles at the same time by the same angle, and the rotational nozzles are oriented such that the nozzle hole in the tip portion of each of the rotational nozzles is oriented most outwardly relative to a center of the nozzle device on the spraying side at the same time.

In this structure, each of the rotational nozzles rotates at the same time by the same angle, and the orientation of the nozzle hole in the tip portion of each rotational nozzle changes in synchronization. In this case, the relative change in the direction in which the fluid is sprayed from each rotational nozzle becomes regular. The nozzle device changes the spraying angle regularly. The spraying angle is thus easy to control.

In the nozzle device according to the aspect of the present invention in which the orientation of the nozzle hole in the tip portion of each rotational nozzle changes in synchronization, a tilt angle at which the rotation axis of each rotational nozzle is tilted relative to the axis of the nozzle device in a direction away from the center of the nozzle device on the spraying side is identical to a tilt angle at which the axis of the nozzle hole in the tip portion of each rotational nozzle is tilted relative to the rotation axis of the rotational nozzle.

In this structure, when the nozzle hole in the tip portion of each rotational nozzle is oriented most inwardly relative to the center of the nozzle device on the spraying side, the axis of the nozzle hole in the tip portion of each rotational nozzle is parallel to the axis of the nozzle device. In this manner, the nozzle device can change the spraying angle at which the fluid is sprayed, and can also spray a straight jet.

In the nozzle device according to the aspect of the present invention, each of the rotational nozzles arranged in the body in correspondence with the spray holes has the rotational axis that is tilted relative to an axis of the nozzle device in a spraying direction toward a center of the nozzle device on the spraying side.

The rotational axis of the rotational nozzle is tilted relative to the axis of the nozzle device in the spraying direction toward the center of the nozzle device on the spraying side. The nozzle device with this structure can change the spraying angle at which the fluid is sprayed by rotating the rotational nozzles.

In the nozzle device according to the aspect of the present invention, the body includes a central spray hole that is open in a central portion of the body on the spraying side and communicates with the supply inlet inside the body.

The central spray hole allows the fluid to be sprayed toward the central portion within the fluid spraying range.

In the nozzle device according to the aspect of the present invention including a rotational ring as the control member, the rotational nozzles are arranged on the same circumference in the body on the spraying side, the protrusion of each rotational nozzle includes a gear arranged in its base on the side of the body, and the rotational ring includes a ring gear on an inner circumferential surface facing the gear, and the ring gear is engaged with the gear.

In the structure, the gear on the base of the protrusion of the rotational nozzle is engaged with the ring gear on the inner circumferential surface of the rotational ring to allow the rotational nozzles to be rotated when an operation to rotate the rotational ring is performed. The rotation control mechanism includes the gear and the ring gear. The nozzle device has the simple structure and includes fewer parts, and thus is easy to handle.

Advantageous Effects

The structures according to the above aspect of the present invention produce the advantages described below.

In the nozzle device according the aspect of the present invention, the control member can be operated to cause the rotation control mechanism to rotate the plurality of rotational nozzles and to change the orientation of the nozzle hole in the tip portion of each rotational nozzle. This changes the direction in which a fluid is sprayed from each of the rotational nozzles.

As the direction in which the fluid is sprayed from each rotational nozzle changes, the relative direction of the fluid sprayed from each rotational nozzle changes accordingly. As a result, the nozzle device can change the angle at which the fluid is sprayed.

The spraying angle is changed by rotating the rotational nozzles, which is achieved by operating the control member. Thus, the spraying angle can be changed using the simple structure.

The pressure of the fluid applied on the nozzle hole of each rotational nozzle acts in the direction to push the rotational nozzle toward the spraying side in the direction of the rotation axis of the rotational nozzle. Thus, almost no such fluid pressure is applied in the direction of rotation of the rotational nozzle, which is substantially perpendicular to the above spraying side direction. Thus, almost no such fluid pressure affects the operation of the control member for rotating the rotational nozzles. Although the pressure of the fluid is high, the spraying angle of the fluid can be changed easily by operating the control member with small power.

In the structure including the rotational ring, the rotational ring, which is the control member, can be operated and rotated to cause the rotation control mechanism to rotate the plurality of rotational nozzles. As a result, the nozzle device can change the angle at which the fluid is sprayed. The spraying angle is changed by rotating the rotational nozzles, which is achieved by operating and rotating the rotational ring. Thus, the spraying angle can be changed using the simple structure.

In the structure including the dial, the dial, which is the control member, can be operated and rotated to cause the rotation control mechanism to rotate the plurality of rotational nozzles. As a result, the nozzle device can change the angle at which the fluid is sprayed. The spraying angle is changed by rotating the rotational nozzles, which is achieved by operating and rotating the dial. Thus, the spraying angle can be changed using the simple structure.

In the structure including the lever, the lever, which is the control member, can be operated to change the orientation of the lever to cause the rotation control mechanism to rotate the plurality of rotational nozzles. As a result, the nozzle device can change the angle at which the fluid is sprayed. The spraying angle is changed by rotating the rotational nozzles, which is achieved by operating the lever to change the orientation of the lever. Thus, the spraying angle can be changed using the simple structure.

With the structure in which each rotational nozzle integrally includes the tip portion and the axis of the tip portion of each rotational nozzle is identical to the rotation axis of the rotational nozzle, the nozzle device includes fewer parts. The tip portion of each rotational nozzle does not sway when the control member is operated. The nozzle device is thus easy to handle.

In the structure in which the nozzle holes are all tilted at a fixed angle relative to the rotation axis of each rotational nozzle, the nozzle holes are oriented in the fixed direction. The nozzle holes are thus easy to process.

When the rotation axis of each rotational nozzle is parallel to the axis of the nozzle device in the spraying direction, the spray hole for receiving each rotational nozzle can be formed easily. When the rotation axis of each rotational nozzle is tilted relative to the axis of the nozzle device in the spraying direction away from the center of the nozzle device on the spraying side, the fluid can be easily sprayed at a wide spraying angle.

In the structure in which the orientation of the nozzle hole in the tip portion of each rotational nozzle changes in synchronization, the relative change in the direction in which the fluid is sprayed from each rotational nozzle becomes regular. The nozzle device changes the spraying angle regularly. The spraying angle is thus easy to control.

With the structure in which the orientation of the nozzle hole in the tip portion of each rotational nozzle changes in synchronization and the tilt angle at which the rotation axis of each rotational nozzle is tilted relative to the axis of the nozzle device away from the center of the nozzle device on the spraying side is identical to the tilt angle at which the axis of the nozzle hole in the tip portion of each rotational nozzle is tilted relative to the rotation axis of the rotational nozzle, the nozzle device can change the spraying angle at which the fluid is sprayed, and can also spray a straight jet.

With the structure in which the rotation axis of each rotational nozzle is tilted relative to the axis of the nozzle device toward the spraying side in the direction toward the center of the nozzle device on the spraying side, the nozzle device can change the spraying angle at which the fluid is sprayed by rotating the rotational nozzles.

The structure including the central spray hole allows the fluid to be sprayed toward the central portion within the fluid spraying range.

With the structure including the rotational ring as the control member and the rotation control mechanism including the gear on the base of the rotational nozzle that is engaged with the ring gear on the inner circumferential surface of the rotational ring, the nozzle device has the simple structure and includes fewer parts, and thus is easy to handle.

DETAILED DESCRIPTION

Embodiments of the present invention will now be described.

Embodiment 1

Structure of Nozzle Device

Figure 1:
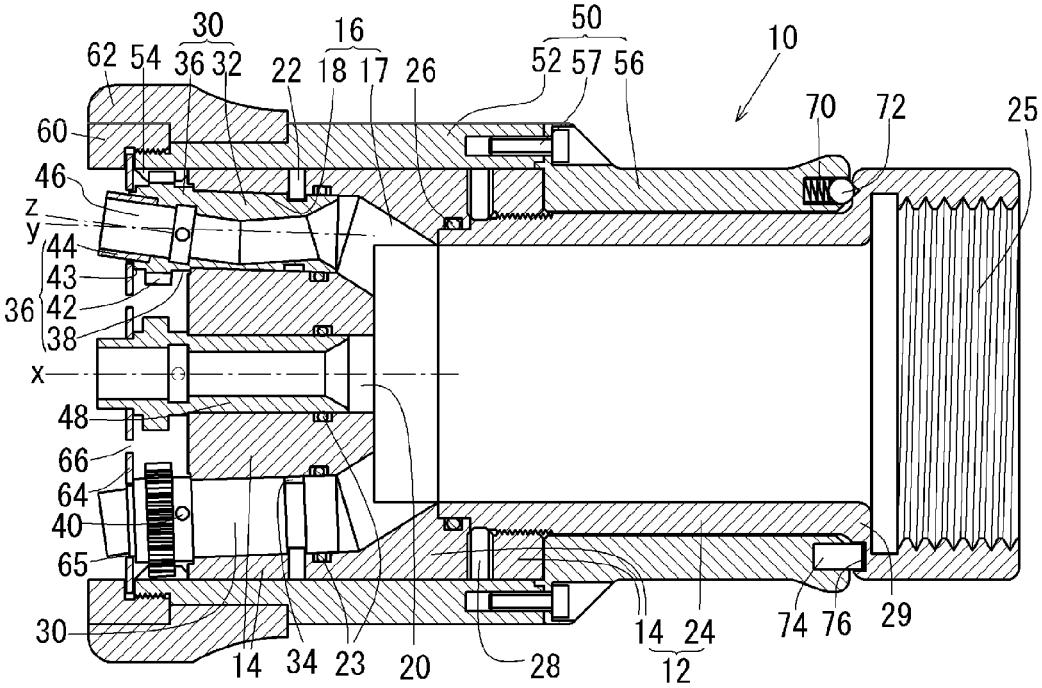
FIG. 1 is a partial cross-sectional view of a nozzle device according to embodiment 1.
Figure 2:
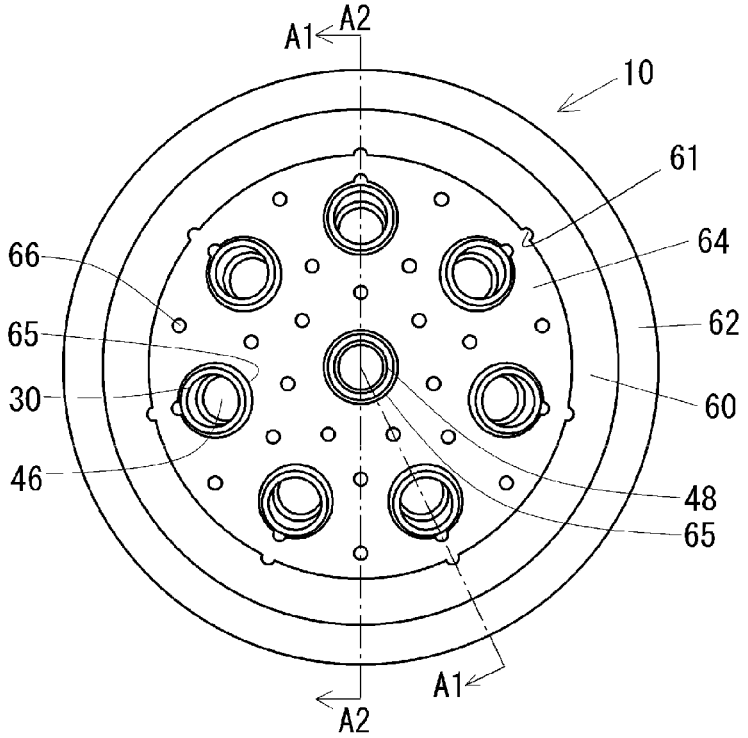
FIG. 2 is a diagram showing the nozzle device according to embodiment 1 as viewed from the spraying side.

FIG. 1 is a partial cross-sectional view showing the structure of a nozzle device 10 according to embodiment 1 of the present invention. FIG. 2 is a diagram showing the nozzle device 10 as viewed from the spraying side. The nozzle device 10 is a multi-hole nozzle used for fire extinguishing work, and includes a body 12, seven rotational nozzles 30, and a rotational ring 50. The rotational ring 50 corresponds to a control member of the present invention.

The body 12 is a hollow member including a nozzle holder 14, which is cylindrical and has a hollow structure on one side, and a water-supply pipe joint 24, which is tubular. The nozzle holder 14 and the water-supply pipe joint 24 are integrated together by screwing. The nozzle device 10 is externally cylindrical. The body 12 is coaxial with the nozzle device 10, and has the same radial direction as the nozzle device 10. In the axial direction of the nozzle device 10, one side of the body 12 where the nozzle holder 14 is arranged is referred to as a spraying side, the other side of the body 12 where the water-supply pipe joint 24 is arranged is referred to as a water supply side, and the direction from the water-supply pipe joint 24 toward the nozzle holder 14 is referred to as a spraying direction.

An O-ring 26, which prevents water leakage, is mounted on one end of the water-supply pipe joint 24 on the spraying side. A fixing screw 28, which prevents unscrewing between the nozzle holder 14 and the water-supply pipe joint 24, is mounted on one end of the screwed portion on the spraying side. The fixing screw 28 is arranged in the radial direction.

A central spray hole 20 is formed in the center of the nozzle holder 14 to extend parallel to an axis x of the nozzle device 10. The central spray hole 20 is surrounded by seven spray holes 16, which are formed through the nozzle holder 14 from its spraying side to the water supply side.

FIG. 1 shows a cross-section taken along line A1-A1 in FIG. 2 within the range from the spraying side to the spray hole 16, and shows a cross-section taken along line A2-A2 in FIG. 2 within the range from the screwed portion between the nozzle holder 14 and the water-supply pipe joint 24 to the water supply side. In FIG. 1, rotational nozzles 30 at the back are not shown.

Each spray hole 16 includes a rotational nozzle receiving part 18, which is open on the spraying side, and a branch part 17, which communicates with the rotational nozzle receiving part 18 and is open on the water supply side. The rotational nozzle receiving parts 18 are arranged at equal intervals on a circumference centered on the central axis of the nozzle device 10. Each rotational nozzle receiving part 18 is tilted at an angle of 2 degrees relative to the axis x of the nozzle device 10 to extend outwardly in the radial direction toward the spraying side.

The water-supply pipe joint 24 includes a water inlet portion 25, which has a female thread for connecting the water-supply pipe joint 24 to a water pipe by screwing, in its end on the water supply side. The water-supply pipe joint 24 includes a portion with a smaller outer diameter than the nozzle holder 14 on the spraying side, and includes the water inlet portion 25 with an enlarged outer diameter, which is substantially the same as the outer diameter of the nozzle holder 14. The water-supply pipe joint 24 includes a step portion 29 where the outer diameter changes. The central spray hole 20 and the spray holes 16 communicate with the water inlet portion 25 through the hollow in the body 12.

Each rotational nozzle 30 is a hollow member having a nozzle hole 46 in its center. Each rotational nozzle 30 is arranged in the nozzle holder 14 of the body 12 such that its insertion part 32 on the water supply side internally touches the rotational nozzle receiving part 18 of the spray hole 16 and its protrusion 36 on the spraying side protrudes on the spraying side of the spray hole 16. The rotational nozzle receiving part 18 has a groove on its inner circumferential surface to extend across the entire circumference at a position facing around a distal end of the insertion part 32. A resilient sealant ring 23, which prevents water leakage from a gap between the insertion part 32 and the rotational nozzle receiving part 18, is fitted in the groove.

The rotational nozzle 30 further has a ring engagement groove 34 on the outer circumferential surface of its insertion part 32 to extend across the entire circumference. The engagement groove 34 receives a retainer pin 22, which is placed through a hole in the radial direction that is open in an outer circumferential surface of the nozzle holder 14. The tip of the retainer pin 22 protrudes from the wall surface of the rotational nozzle receiving part 18 inside the rotational nozzle receiving part 18 and is engaged with the engagement groove 34 to retain the rotational nozzle 30 to the nozzle holder 14 of the body 12 in a rotatable manner.

The insertion part 32 included in the rotational nozzle 30, which internally touches the rotational nozzle receiving part 18 of the spray hole 16, has an axis y, which serves as the axis of rotation of the rotational nozzle 30. The axis y is tilted at an angle of 2 degrees relative to the axis x of the nozzle device 10 to extend outwardly in the radial direction of the nozzle device 10 in the spraying direction. The tilt angle at which the axis y of the rotational nozzle 30 is tilted relative to the axis x of the nozzle device 10 to extend outwardly in the radial direction of the nozzle device 10 toward the spraying side is referred to as a nozzle axis tilt angle in embodiments of the present invention. For this nozzle device 10, the nozzle axis tilt angle is 2 degrees.

A fixed nozzle 48, which has a central nozzle hole, is placed through the central spray hole 20. A groove is formed on the inner circumferential surface of the central spray hole 20 to extend across the entire circumference at a position facing around an end of the fixed nozzle 48 on the water supply side. A sealant ring 23, which prevents water leakage from a gap between the fixed nozzle 48 and the central spray hole 20, is fitted in the groove.

The fixed nozzle 48 has an engagement hole in its outer circumferential surface. The tip of a retainer pin for the fixed nozzle 48 placed through a hole in the radial direction that is open in an outer circumference of the nozzle holder 14 is engaged with the engagement hole of the fixed nozzle 48 to prevent the fixed nozzle 48 from being released from the central spray hole 20. The engagement hole in the fixed nozzle 48 and the corresponding retainer pin are not shown in FIG. 1.

A base 38 of the protrusion 36 included in the rotational nozzle 30 on the side of the body 12 has an outer diameter larger than the inner diameter of the rotational nozzle receiving part 18 of the spray hole 16. A portion of the rotational nozzle receiving part 18 around its opening has a countersunk hole with a slightly larger diameter than the base 38. The countersunk hole receives a distal end of the base 38. The distal end of the base 38 comes in contact with the opening of the rotational nozzle receiving part 18, where the axial position of the rotational nozzle 30 is determined. A gear 42, which has a still larger outer diameter than the base 38, is arranged on the spraying side of the base 38 of the protrusion 36 included in the rotational nozzle 30. The gear 42 is integral with the rotational nozzle 30.

A portion of the nozzle hole 46 of the rotational nozzle 30 from the protrusion 36 to an intermediate position of the insertion part 32 continuous from the protrusion 36 is tilted at an angle of 6 degrees relative to the rotation axis of the rotational nozzle 30. The nozzle hole 46 has a portion with a large diameter corresponding to the base 38 of the protrusion 36. This large diameter portion has two facing air holes 40, which are open in the outer circumferential surface of the protrusion 36. The nozzle hole 46 has this large-diameter portion with the air holes 40 to allow air to be taken in efficiently through the air holes 40 with the Venturi effect.

The nozzle hole 46 has a portion corresponding to the remaining portion of the insertion part 32 extending toward the center of the end of the insertion part 32 on the water supply side, and has a conical portion with a large diameter at the water supply side end of the insertion part 32.

At an end of the protrusion 36 on the spraying side, a tubular tip portion 44 is placed through the nozzle hole 46 and fixed to the protrusion 36 with adhesive. As a result, the axis z of the nozzle hole 46 in the tip portion 44 of the rotational nozzle 30 is tilted at an angle of 6 degrees relative to the axis y of the rotational nozzle 30. The tilt angle of the axis z of the nozzle hole 46 in the tip portion 44 of the rotational nozzle 30 relative to the axis y of the rotational nozzle 30 is referred to as a nozzle hole tilt angle. For this nozzle device 10, the nozzle hole tilt angle is 6 degrees.

The tip portion 44 of the rotational nozzle 30 and the gear 42 are sized to fall within the outer diameter of the nozzle holder 14.

The rotational ring 50 includes a tubular case 52, which covers the exterior of the nozzle holder 14, and a tubular grip 56, which covers the exterior of the water-supply pipe joint 24. The case 52 and the grip 56 are fastened together with fastener screws 57. The rotational ring 50 is rotatable relative to the body 12. An end of the grip 56 on the water supply side faces the step portion 29 included in the water-supply pipe joint 24 with a small gap left between the end of the grip 56 and the step portion 29.

The end of the grip 56 on the water supply side has two axial holes at opposite positions in the radial direction. A stick pin 74 is placed through one of the holes. The tip of the pin 74 protruding from the hole is engaged with an arc-like groove 76 formed on the surface of the step portion 29 in the water-supply pipe joint 24 on the spraying side to regulate the rotatable range of the rotational ring 50.

The other hole accommodates a spring 70 and a sphere 72. A plurality of recesses are formed on the surface of the step portion 29 in the water-supply pipe joint 24 on the spraying side, on which the sphere 72 will move, to provide tactile response when the rotational ring 50 rotates.

A ring gear 54, which is engaged with each gear 42, is arranged on the inner circumferential surface of the case 52 at a position facing each gear 42 arranged on the protrusion 36 included in the rotational nozzle 30. The gears 42 and the ring gear 54 correspond to a rotation control mechanism of the present invention.

A cover 64, which has a nozzle receiving hole 65 and an air hole 66, is mounted on a distal end of the case 52 of the rotational ring 50 on the spraying side. The cover 64 prevents foreign matter from entering an engaged portion between the gear 42 of the rotational nozzle 30 and the ring gear 54 of the case 52, and provides passage of air flowing toward the air hole 40 formed in the rotational nozzle 30.

The rotational nozzle 30 includes a cover retainer 43, which is arranged on the spraying side from the gear 42 on the protrusion 36. A tip portion of the cover retainer 43 has an outer diameter slightly smaller than the inner diameter of the nozzle receiving hole 65. A portion of the cover retainer 43 on the side of the gear 42 has an outer diameter larger than the inner diameter of the nozzle receiving hole 65. The cover retainer 43 thus has a step portion, which causes such changes in the outer diameter. The tip portion of the cover retainer 43 included in the rotational nozzle 30 protrudes from the nozzle receiving hole 65 toward the spraying side, and the step portion of the cover retainer 43 comes in contact with the cover 64 to prevent entry of foreign matter from the nozzle receiving hole 65. In the same manner as for the rotational nozzle 30, a tip portion of the fixed nozzle 48 also includes a step portion that causes changes in the outer diameter. An end of the tip portion of the fixed nozzle 48 protrudes from the nozzle receiving hole 65 toward the spraying side. The step portion of the tip portion comes in contact with the cover 64 to prevent entry of foreign matter from the nozzle receiving hole 65 corresponding to the fixed nozzle 48.

Almost no air flows through the nozzle receiving hole 65. To provide passage of air flowing inside the cover 64, the cover 64 has many air holes 66 with a small diameter as shown in FIG. 2.

A tubular stopper 60, which has an L-shaped cross-section and has a smaller inner diameter on the spraying side than the cover 64 and a larger inner diameter on the water supply side than the cover 64, is arranged on the cover 64 on the spraying side. The stopper 60 is screwed with the case 52. The cover 64 is held between the stopper 60 and the tip portion of the case 52 on the spraying side in a relatively rotatable manner. A protective guard 62 is mounted on outer diameter portions of the stopper 60 and the case 52.

Figure 3:
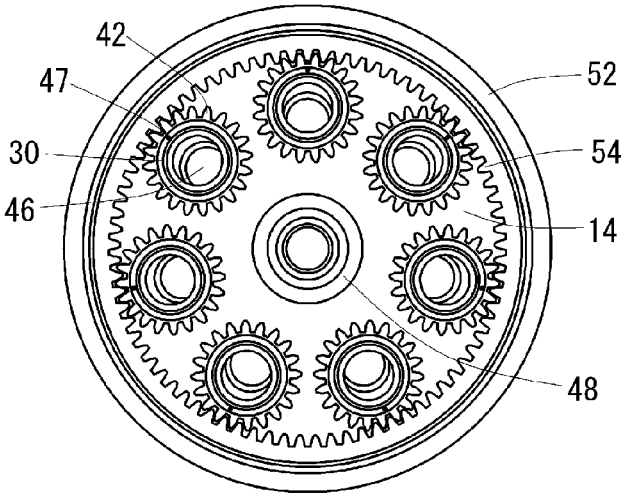
FIG. 3 is a diagram showing the nozzle device according to embodiment 1 as viewed from the spraying side from which a top cover and other parts have been removed.

FIG. 3 is a diagram showing the nozzle device 10 as viewed from the spraying side, from which the stopper 60, the guard 62, and the cover 64 are removed.

Among the parts of the nozzle device 10, the nozzle holder 14, the rotational nozzles 30, the fixed nozzle 48, and the grip 56 are formed from polyacetal, the guard 62 is formed from an elastomer, and the case 52, the water-supply pipe joint 24, and the stopper 60 are formed from aluminum. The materials for these parts are not limited to these. All parts of the nozzle device 10 may be formed from resin, such as polyacetal. All parts may be formed from metal, such as aluminum or brass. Resin parts are lightweight and prevent rust and seizure. Metal parts have higher strength.

Assembling the Nozzle Device

After the sealant ring 23 is placed in the ring groove of the central spray hole 20, the fixed nozzle 48 is placed through the central spray hole 20 from the spraying side of the nozzle holder 14, and is fixed with a retainer pin to prevent the fixed nozzle 48 from being released. Subsequently, the sealant ring 23 is placed in the ring groove of each spray hole 16, and then the rotational nozzle 30 is placed through the rotational nozzle receiving part 18 of each spray hole 16 from the spraying side of the nozzle holder 14. The retainer pin 22 is inserted from the outer diameter side of the nozzle holder 14 until the tip of the retainer pin 22 is engaged with the engagement groove 34 of the rotational nozzle 30 to retain the rotational nozzle 30 in the spray hole 16 in a rotatable manner.

Subsequently, the pin 74 is placed in one of the two holes arranged in the axial direction in the end of the grip 56 on the water supply side. The spring 70 and the sphere 72 are then placed in the other hole. The tip of the pin 74 protruding from the end of the grip 56 is engaged with the arc-like groove 76 formed on the step portion 29 included in the water-supply pipe joint 24, and the grip 56 covers the outer diameter portion of the water-supply pipe joint 24.

The O-ring 26 is mounted in the groove on the nozzle holder 14 on the water supply side, and the inner diameter portion of the nozzle holder 14 is screwed with the outer diameter portion of the water-supply pipe joint 24. The fixing screw 28 is then screwed into the screwed portion of the nozzle holder 14 and the water-supply pipe joint 24 to prevent unscrewing of the nozzle holder 14 and the water-supply pipe joint 24.

As shown in FIG. 3, the rotational positions of the rotational nozzles 30 are then adjusted such that the nozzle holes 46 in the tip portions 44 of all the rotational nozzles 30 are oriented outwardly in the radial direction of the nozzle device 10. Each rotational nozzle 30 has a tilt mark 47, which indicates the tilt direction of the nozzle hole 46 in the tip portion 44. Thus, the rotational position of each rotational nozzle 30 is adjusted by aligning the tilt mark 47 outwardly in the radial direction of the nozzle holder 14.

The case 52 of the rotational ring 50 is held with the ring gear 54 oriented toward the spraying side. The case 52 is then placed over the nozzle holder 14 from the spraying side of the nozzle holder 14 until the ring gear 54 included in the case 52 is engaged with the gear 42 on the protrusion 36 included in each rotational nozzle 30. In FIG. 3, the ring gear 54 is engaged with each gear 42 in the state described above.

Subsequently, the case 52 and the grip 56 are screwed together with the fastener screws 57 to integrate these parts of the rotational ring 50. The tip portion 44 of the rotational nozzle 30 is placed through the nozzle receiving hole 65 formed in the cover 64 from the spraying side of the nozzle holder 14. The cover 64 is then mounted on the spraying side of the nozzle holder 14. The guard 62 is placed on the outer diameter portion of the case 52, and the stopper 60 is screwed with the case 52 from the inner diameter side of the guard 62. The guard 62 is then rotated in the direction to tighten the stopper 60 to rotate the stopper 60 together. This tightens the stopper 60. The stopper 60 may also be tightened using a dedicated tool for seven auxiliary grooves 61, which may axially extend on the inner circumferential surface of the stopper 60.

Changes in the Spraying Angle

Figure 4:
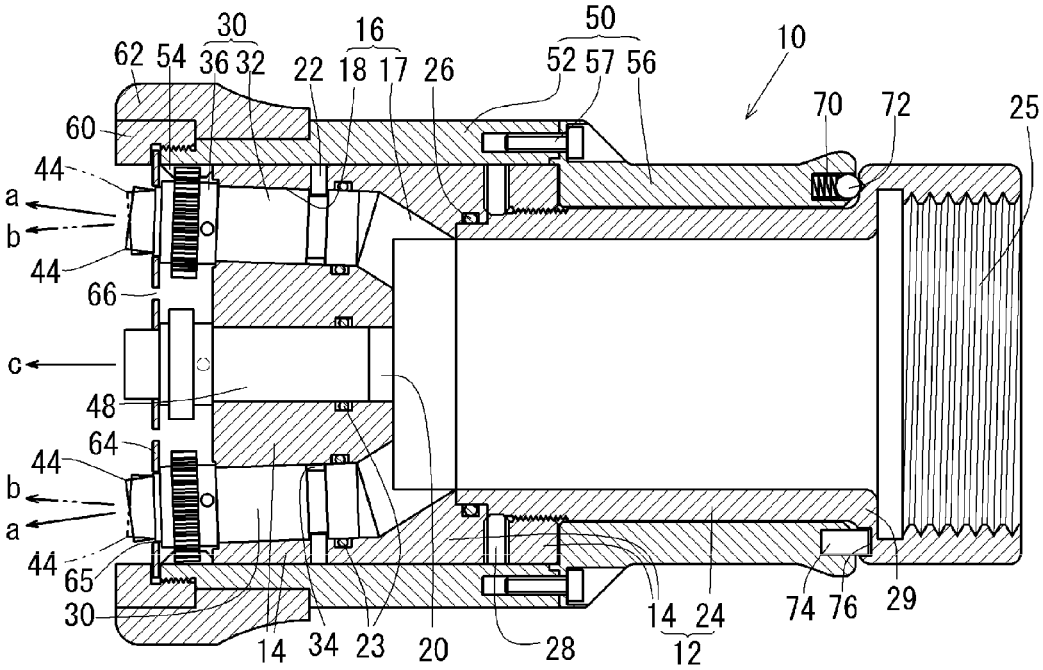
FIG. 4 is a diagram describing changes in the water spraying range caused by rotation of rotational nozzles in the nozzle device according to embodiment 1.

Referring to FIG. 4, changes in the direction in which water is sprayed by the nozzle device 10 will now be described. FIG. 4 shows a cross-section of the nozzle device 10 taken along line A1-A1 in FIG. 2 on the spraying side. Each gear 42 arranged on the protrusion 36 included in each rotational nozzle 30 has the same number of teeth. Each rotational nozzle 30 rotates by the same angle in cooperation with rotation of the rotational ring 50. In FIG. 4, an arrow a indicates the direction of the axis z of the nozzle hole 46 in the tip portion 44 of each rotational nozzle 30 in the assembled state shown in FIG. 3. The arrow drawn using a solid line indicates the direction of the tip portion 44 at this position. An arrow b indicates the direction of the axis z of the nozzle hole 46 in the tip portion 44 of the rotational nozzle 30 after the rotational nozzle 30 moves by an angle of 180 degrees when the rotational ring 50 is rotated. The arrow drawn using an imaginary line indicates the direction of the tip portion 44 at this position. An arrow c indicates the direction of the nozzle hole in the tip portion of the fixed nozzle 48, which is fixed.

In the nozzle device 10, the axis y of each rotational nozzle 30 is tilted at an angle of 2 degrees relative to the axis x of the nozzle device 10, and the axis z of the nozzle hole 46 in the tip portion 44 of each rotational nozzle 30 is tilted at an angle of 6 degrees relative to the axis y of the rotational nozzle 30. With the nozzle axis tilt angle of 2 degrees and the nozzle hole tilt angle of 6 degrees, this nozzle device 10 will have a spraying angle of 2 plus 6, or 8 degrees outwardly on one side and thus will have a spraying angle of 16 degrees outwardly on the two sides together when the nozzle hole 46 is oriented most outwardly. When the nozzle hole 46 is oriented most inwardly, the nozzle device 10 will have a spraying angle of 2 minus 6, or −4 degrees (4 degrees inwardly) on one side, and thus will have a spraying angle of 8 degrees inwardly on the two sides together.

A focal point of the nozzle device according to embodiments of the present invention will now be described. When the nozzle hole tilt angle is larger than the nozzle axis tilt angle as in the nozzle device 10 according to embodiment 1, jets of water sprayed from the rotational nozzles seem to converge to one point at a predetermined distance when the nozzle hole formed in the tip portion of each rotational nozzle is oriented most inwardly in the radial direction. The point where the water jets converge is referred to as a focal point of the nozzle device. The focal point distance is shorter as the difference between the nozzle axis tilt angle and the nozzle hole tilt angle is larger. The focal point distance is longer as the difference between these angles is smaller. This characteristic can be used to allow the jets of water sprayed from the rotational nozzles to converge to one point at a predetermined distance.

The inventor of the present application conducted an experiment on water spraying using the nozzle device 10 according to embodiment 1. Jets of water from the nozzle holes 46 in the tip portions 44 of the rotational nozzles 30 oriented most inwardly in the radial direction converge into a single linear jet near the focal point, which then travels while maintaining its linear shape. The inventor confirmed that the nozzle device 10 according to embodiment 1 can spray water to a more distant place than a single-hole nozzle under the same water pressure.

When the nozzle hole 46 in the tip portion 44 of each rotational nozzle 30 is oriented inwardly in the radial direction but more outwardly from the focal point, jets of water sprayed from the nozzle holes 46 cross one another at a predetermined distance and then disperse.

Effects of Invention

In the nozzle device 10 according to embodiment 1, the orientation of the nozzle hole 46 in the tip portion 44 of each rotational nozzle 30 changes continuously from the direction of the arrow a to the direction of the arrow b shown in FIG. 4 in accordance with rotation of the rotational ring 50. Thus, the nozzle device 10 can continuously change the angle of water sprayed from the tip portions 44 of the rotational nozzles 30. In fire extinguishing work, the nozzle device 10 can substantially concentrically increase and decrease the range of water spraying by rotating the rotational ring 50 in correspondence with the range intended for fire extinguishing. To extinguish fires while displacing obstacles, the nozzle holes 46 in the tip portions 44 are all oriented in the direction of the arrow b shown in FIG. 4 to create a linear water jet with higher pressure at its destination so that the nozzle device 10 can serve like a single-hole nozzle.

As described above, the mechanism for changing the spraying angle of the nozzle device 10 includes simply rotating the rotational nozzles 30 in each of which the axis z of the nozzle hole 46 in the tip portion 44 is tilted relative to the axis y of the insertion part 32 using the ring gear 54 included in the rotational ring 50. The nozzle device 10 thus includes fewer parts, and is easy to handle, and features high durability and easy maintenance.

The pressure of water applied on the nozzle hole 46 of each rotational nozzle 30 acts in the direction to push the rotational nozzle 30 toward the spraying side in the direction of the axis y, which is the rotation axis of the rotational nozzle 30. Thus, almost no such water pressure is applied in the direction of rotation of the rotational ring 50, which is substantially perpendicular to the above spraying side direction. Although the pressure of water to be sprayed is high, the spraying angle of the water can be changed easily by rotating the rotational ring 50 with small power.

Embodiment 2

Figure 5:
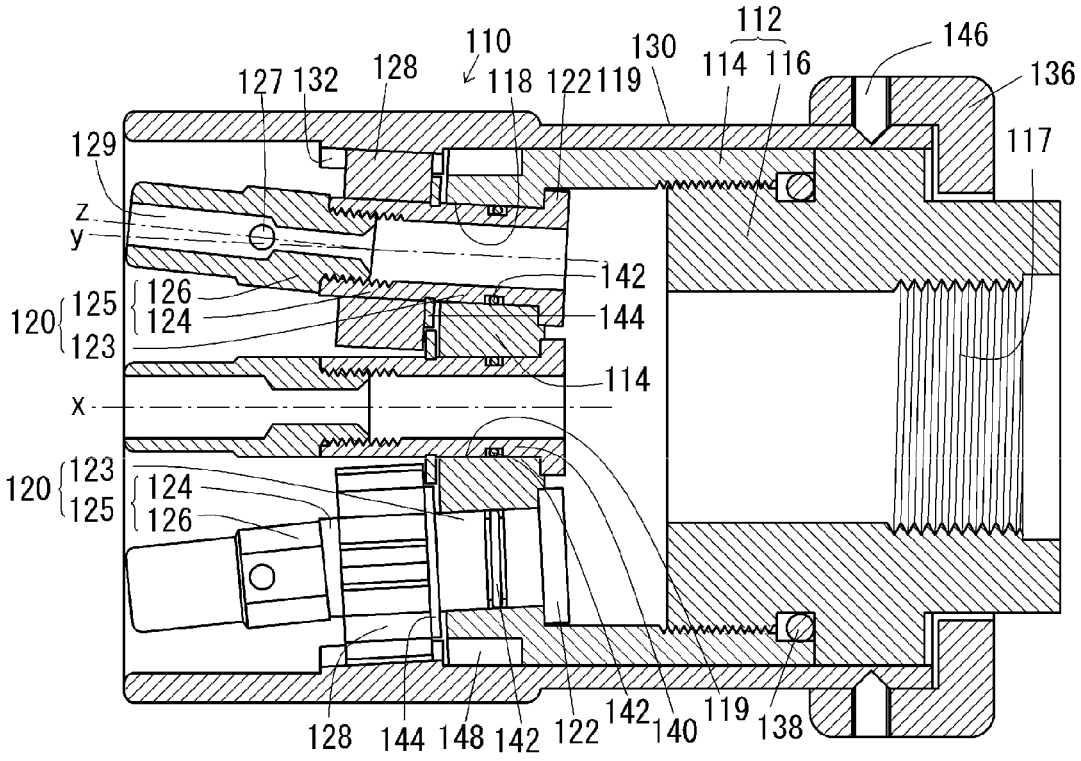
FIG. 5 is a partial cross-sectional view showing the structure of a nozzle device according to embodiment 2.

FIG. 5 is a partial cross-sectional view showing the structure of a nozzle device 110 according to embodiment 2 of the present invention. The nozzle device 110 is a multi-hole nozzle used for fire extinguishing work, and includes a body 112, rotational nozzles 120, a rotational ring 130, a fixed nozzle 140, and an auxiliary ring 136. The rotational ring 130 corresponds to the control member of the present invention as in embodiment 1.

The body 112 is a hollow member including a tubular nozzle holder 114 and a tubular water-supply pipe joint 116, which are integrated together by screwing. The nozzle device 110 is externally cylindrical. The body 112 is coaxial with the nozzle device 110, and has the same radial direction as the nozzle device 110. In the axial direction of the nozzle device 110, one side of the body 112 where the nozzle holder 114 is arranged is referred to as a spraying side, the other side of the body 112 where the water-supply pipe joint 116 is arranged is referred to as a water supply side, and the direction from the water-supply pipe joint 116 toward the nozzle holder 114 is referred to as a spraying direction. An O-ring 138, which prevents water leakage, is mounted on one end of the screwed portion between the nozzle holder 114 and the water-supply pipe join 116 on the spraying side.

The water-supply pipe joint 116 includes a water inlet portion 117, which has a female thread for connecting the water-supply pipe joint 116 to a water pipe by screwing. The water-supply pipe joint 116 includes a portion with the same outer diameter as the nozzle holder 114 on the spraying side, and includes the water inlet portion 117 with a smaller outer diameter than the nozzle holder 114.

The nozzle holder 114 has a central spray hole 119 in its center, which extends parallel to the axis x of the nozzle device 110. The central spray hole 119 is surrounded by four spray holes 118, which are arranged at equal intervals on a circumference that is concentric with the central spray hole 119. Each spray hole 118 is arranged at an angle of 3 degrees relative to the axis x of the nozzle device 110 to extend outwardly in the radial direction toward the spraying side. The central spray hole 119 and the spray holes 118 communicate with the water inlet portion 117 through the hollow in the body 112.

The hollow rotational nozzle 120 is placed through each of the four spray holes 118 in the nozzle holder 114 in a rotatable manner. A basal end part 123 of the rotational nozzle 120, which internally touches the spray hole 118, has an axis y, which serves as the axis of rotation of the rotational nozzle 120. The axis y is tilted at an angle of 3 degrees relative to the axis x of the nozzle device 110 to extend outwardly in the radial direction of the nozzle device 110 on the spraying side. For this nozzle device 110, the nozzle axis tilt angle is 3 degrees. The basal end part 123 has a groove on its circumferential surface to extend across the entire circumference. A resilient C-ring 142, which prevents water leakage, is mounted in the groove.

The hollow fixed nozzle 140 is placed through the central spray hole 119. A basal end part of the fixed nozzle 140, which internally touches the central spray hole 119, also has a groove on its outer circumferential surface to extend across the entire circumference. A resilient C-ring 142, which prevents water leakage, is also mounted in the groove.

Each rotational nozzle 120 is a hollow member having a nozzle hole 129 in its center, and includes the basal end part 123 that internally touches the spray hole 118 and a protrusion 125 protruding from the spray hole 118 toward the water spraying side. The basal end part 123 has a flanged end, which serves as a seat 122, on the water supply side. The seat 122 has a larger outer diameter than the inner diameter of the spray hole 118 on the water supply side. The rotational nozzle 120 is retained in the nozzle holder 114 in a rotatable manner with the seat 122 engaged with the end of the spray hole 118 on the water supply side. A gear 128 is mounted on an outer circumferential portion of a base 124 of the protrusion 125 in the rotational nozzle 120 on the side of the body 112. Between the gear 128 and the body 112, a disc-like spacer 144 is mounted in a groove on the outer circumference of the base 124 to provide cushioning between the gear 128 and the body 112.

The protrusion 125 of the rotational nozzle 120 includes a tip portion 126, which protrudes toward the spraying side from the base 124 on which the gear 128 is mounted. The tip portion 126 is fixed to the base 124 by screwing. The axis z of the tip portion 126 is tilted relative to the axis y of the basal end part 123 at a tilt angle of 3 degrees. The nozzle hole 129 in the center of the tip portion 126 extends in the axial direction of the tip portion 126. The rotational nozzle 120 thus has the nozzle hole 129 with its tip portion tilted at an angle of 3 degrees relative to the rotation axis. For this nozzle device 110, the nozzle hole tilt angle is 3 degrees.

The tip portion 126 includes an axial middle portion shaped in a hexagonal prism. Two facing surfaces of the hexagonal prim portion each have an air hole 127, which communicates with the nozzle hole 129 formed in the center of the tip portion 126.

The rotational nozzle 120, on which the tip portion 126, the gear 128, and the spacer 144 are unmounted, and only the C-ring 142 is mounted, is placed through the spray hole 118 from the water supply side. The spacer 144, the gear 128, and the tip portion 126 are mounted onto the protrusion 125, which protrudes toward the spraying side of the spray hole 118. The gear 128 is fixed to the protrusion 125 in the rotational nozzle 120 with a screw having a male thread, which is screwed into a screw hole formed in a valley between adjacent teeth of the gear 128 to communicate with the hollow in the core of the gear 128. The screw hole of the gear 128 and the screw are not shown.

The gear 128 and the tip portion 126, which are mounted on the base 124 of the rotational nozzle 120, are sized to fall within the outer diameter of the nozzle holder 114.

The rotational ring 130 is a tubular member, which covers the exterior of the body 112 in a rotatable manner. A ring gear 132, which is engaged with the gear 128, is arranged on the inner circumferential surface of the rotational ring 130 at a position facing the gear 128 arranged on the base 124 of the rotational nozzle 120. The gear 128 and the ring gear 132 correspond to the rotation control mechanism of the present invention.

An end of the rotational ring 130 on the spraying side extends to an end of the tip portion 126 of the rotational nozzle 120. The rotational ring 130 covers around the rotational nozzle 120 to protect the rotational nozzle 120. An end of the rotational ring 130 on the water supply side extends to a position at which the outer diameter of the water-supply pipe joint 116 decreases.

The auxiliary ring 136 is a tubular member having an L-shaped cross-section. The auxiliary ring 136 covers an outer circumference portion of the water-supply pipe joint 116 with a smaller outer diameter and an outer circumference portion of an end of the rotational ring 130 on the water supply side. The auxiliary ring 136 is joined to the rotational ring 130 with a screw 146 to prevent the rotational ring 130 from being released on the spraying side. A gear 148, which can be engaged with the ring gear 132, is formed on a distal end of the body 112 on the spraying side. When the auxiliary ring 136 is pulled toward the water supply side, the rotational ring 130 joined to the auxiliary ring 136 with the screw 146 is pulled toward the water supply side, causing the ring gear 132 to be engaged with both the gear 128 on the rotational nozzle 120 and the gear 148 on the tip portion of the body 112 on the spraying side. This regulates rotation of the rotational ring 130 and fixes the nozzle device 110 at a predetermined spraying angle.

For the nozzle device 110 according to embodiment 2, the nozzle axis tilt angle and the nozzle hole tilt angle are identical to each other. Thus, the axis z of the nozzle hole 129 is parallel to the axis x of the nozzle device 110 when the tip portions 126 of all the rotational nozzles 120 are oriented most inwardly in the radial direction of the nozzle device 110. As a result, the nozzle device 110 can spray a straight jet of water when an operation to rotate the rotational ring 130 is performed.

Figure 6:
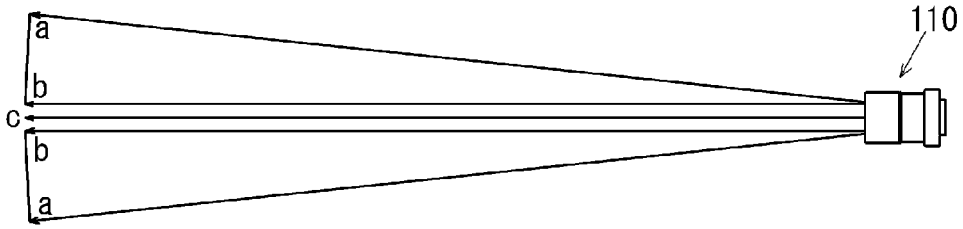
FIG. 6 is a diagram describing changes in the direction in which water is sprayed by the nozzle device according to embodiment 2.

FIG. 6 shows changes in the range of spraying performed by the nozzle device 110. In FIG. 6, an arrow indicates the direction in which water is sprayed when the tip portion 126 of each rotational nozzle 120 is oriented most outwardly in the radial direction of the nozzle device 110. In FIG. 6, an arrow b indicates the direction in which water is sprayed when the tip portion 126 of each rotational nozzle 120 is oriented most inwardly in the radial direction of the nozzle device 110. The direction in which the water is sprayed is the axial direction of the nozzle device 110. An arrow c indicates the direction of water sprayed from the fixed nozzle 140, which does not change.

When the rotational nozzles 120 are rotated, water sprayed from each rotational nozzle 120 leaves a conical trajectory. At a predetermined distance from the nozzle device 110, water sprayed from each rotational nozzle 120 leaves an almost circular trajectory.

Figure 7:
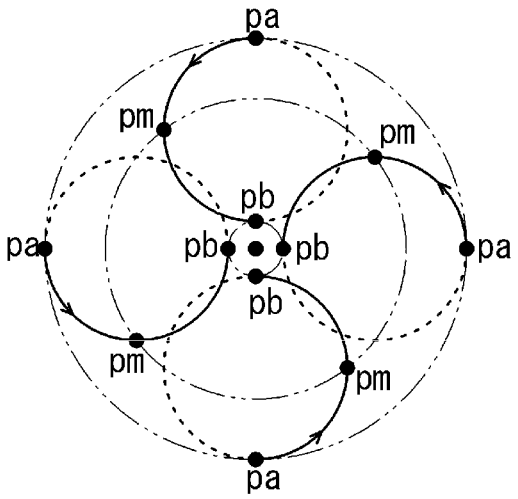
FIG. 7 is a diagram showing the range in which water is sprayed by the nozzle device according to embodiment 2.

FIG. 7 shows changes in the spraying range at a predetermined distance from the nozzle device 110. In the figure, four small circles each represent the trajectory of water sprayed from each rotational nozzle 120 at the position reached by the water. Points pa each indicate the position reached by water when the rotational nozzle 120 is oriented most outwardly, and points pb each indicate the position reached by water when the rotational nozzle 120 is oriented most inwardly. A circle drawn by connecting the points pa represents the water spraying range when each rotational nozzle 120 is oriented most outwardly. A circle drawn by connecting the points pb represents the water spraying range when each rotational nozzle 120 is oriented most inwardly. Points pm each indicate the position reached by water when each rotational nozzle 120 is oriented in an intermediate direction. As shown in FIG. 7, the water spraying range increases or decreases concentrically as each rotational nozzle 120 rotates.

The nozzle device 110 according to embodiment 2 includes the same control member and the same rotation control mechanism as the nozzle device 10 according to embodiment 1. In the same manner as the nozzle device 10, the nozzle device 110 according to embodiment 2 has the simple structure and can change the spraying angle easily. Further, the auxiliary ring 136 can be pulled toward the water supply side to fix the rotational position of the rotational ring 130 and to fix each rotational nozzle 120 oriented in a predetermined direction and thus to maintain the water spraying range within a predetermined range.

Structure of Rotation Control Mechanism

Although embodiments 1 and 2 describe the mechanism in which the gear and the ring gear are directly engaged with each other as a rotation control mechanism when the rotational ring is used as the control member, the rotation control mechanism is not limited to this structure.

Figure 8:
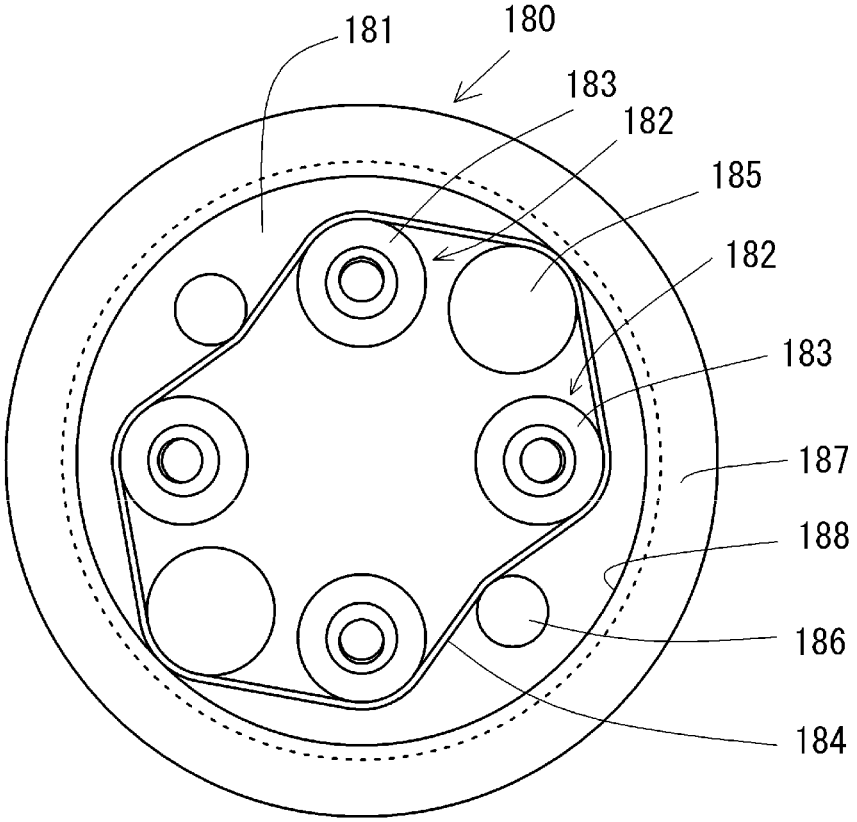
FIG. 8 is a diagram showing an example in which a rotation control mechanism includes a timing belt.

FIG. 8 is a schematic diagram of a nozzle device 180 including a timing belt as a rotation control mechanism as viewed from the spraying side. The teeth of the timing belt and other parts are not shown. The nozzle device 180 shown in FIG. 8 includes four rotational nozzles 182, and pulleys 183 for rotating the rotational nozzles 182. Each pulley 183 is mounted on a base of the corresponding rotational nozzle 182. The nozzle device 180 further includes a timing belt 184, which is arranged on the pulleys 183 of the rotational nozzles 182. A friction member (not shown) is mounted on an inner circumferential surface 188 of a rotational ring 187. Auxiliary pulleys 185, which are arranged on the surface of a body 181 on the spraying side in a rotatable manner, each cause the timing belt 184 to come in contact with the friction member mounted on the inner circumferential surface 188 of the rotational ring 187. To maintain tension of the timing belt 184, rollers 186 are arranged as appropriate on the surface of the body 181 on the spraying side in a rotatable manner.

In the nozzle device 180, the timing belt 184 is driven by an operation to rotate the rotational ring 187. The rotational nozzles 182 are then rotated as the pulleys 183 rotate in cooperation with the driving of the timing belt 184. For the structure using a timing belt, the rotational ring may have teeth arranged in a ring on its inner circumferential surface to engage with the timing belt. The timing belt may be a double-sided timing belt.

For the structure using a timing belt, the rotational nozzles have a higher degree of freedom in their positioning than the structure including a gear and a ring gear that are engaged directly with each other. The structure using a timing belt allows the rotational nozzles that may not be arranged on the same circumference on the body to rotate by the same angle at the same time.

Figure 9:
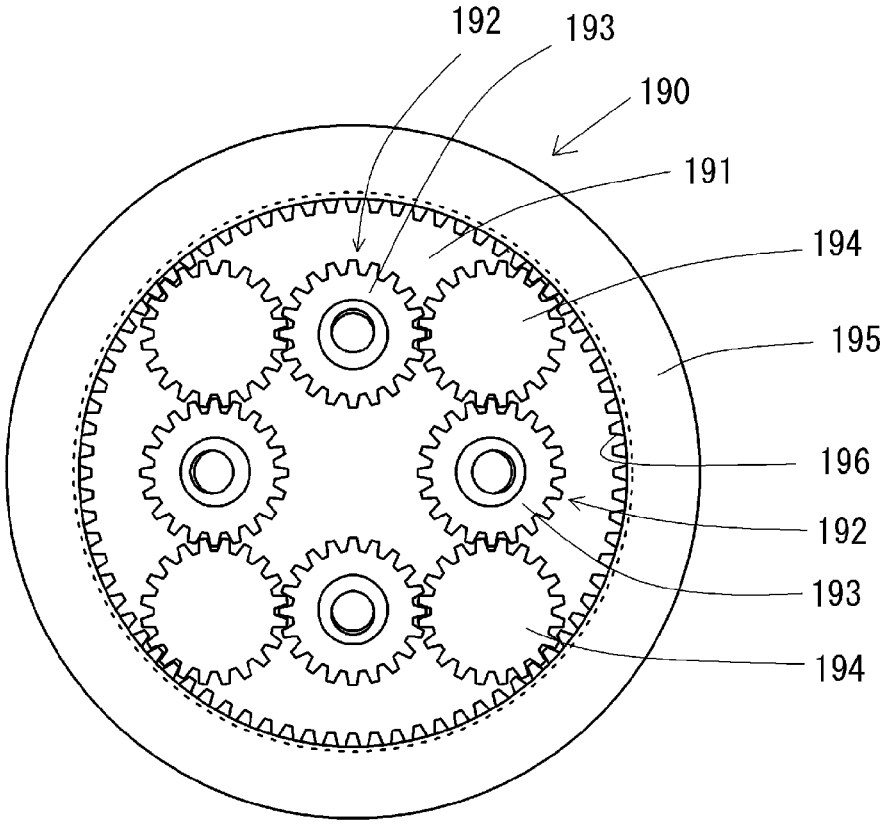
FIG. 9 is a diagram showing an example in which a rotation control mechanism includes auxiliary gears.

FIG. 9 is a schematic diagram of a nozzle device 190 with a rotation control mechanism including auxiliary gears placed in between as viewed from the spraying side. The nozzle device 190 shown in FIG. 9 includes auxiliary gears 194, which are fixed on their shafts and are arranged on the surface of a body 191 on the spraying side in a rotatable manner. The auxiliary gears 194 transmit rotation of a ring gear 196 formed on the inner circumferential surface of a rotational ring 195 to gears 193, which are mounted on the bases of rotational nozzles 192. Although each auxiliary gear 194 is engaged with two gears 193 in this nozzle device 190, each auxiliary gear 194 may be engaged with one gear 193.

The structure including auxiliary gears in between has a higher degree of freedom in positioning the rotational nozzles than the structure including a gear and a ring gear that are directly engaged with each other.

Embodiment 3

Although embodiments 1 and 2 describe the operation to rotate the rotational ring as an operation associated with the control member, the operation associated with the control member is not limited to the operation to rotate the rotational ring.

Figure 10:
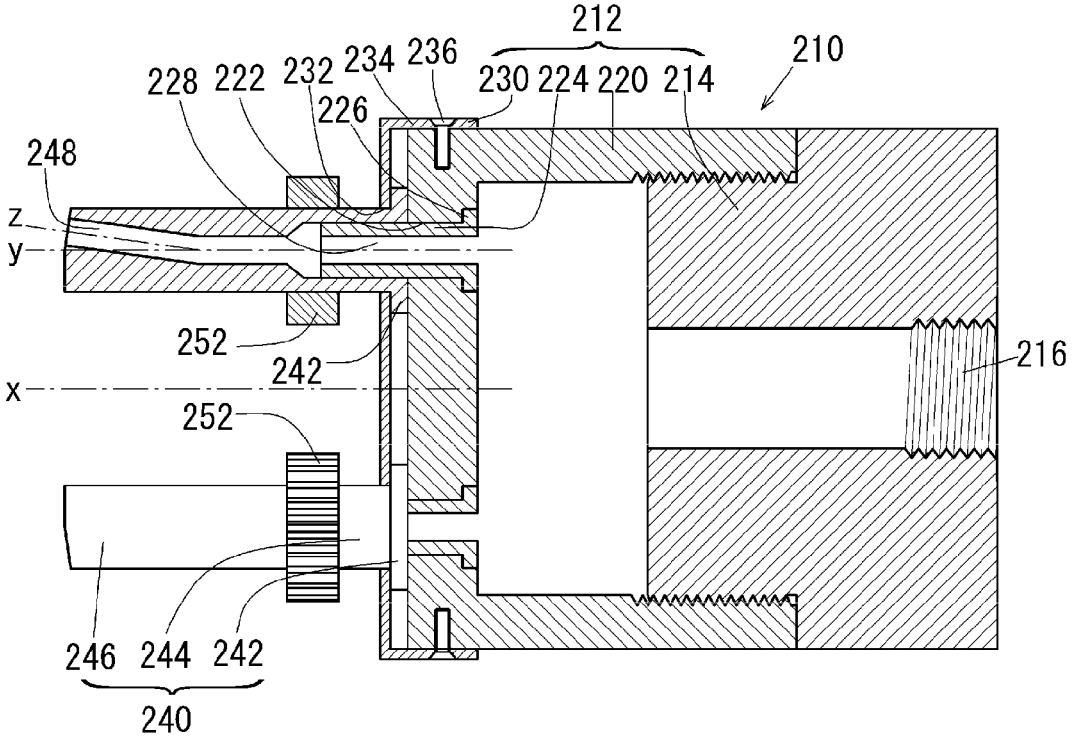
FIG. 10 is a partial cross-sectional view showing the structure of a nozzle device according to embodiment 3.
Figure 11:
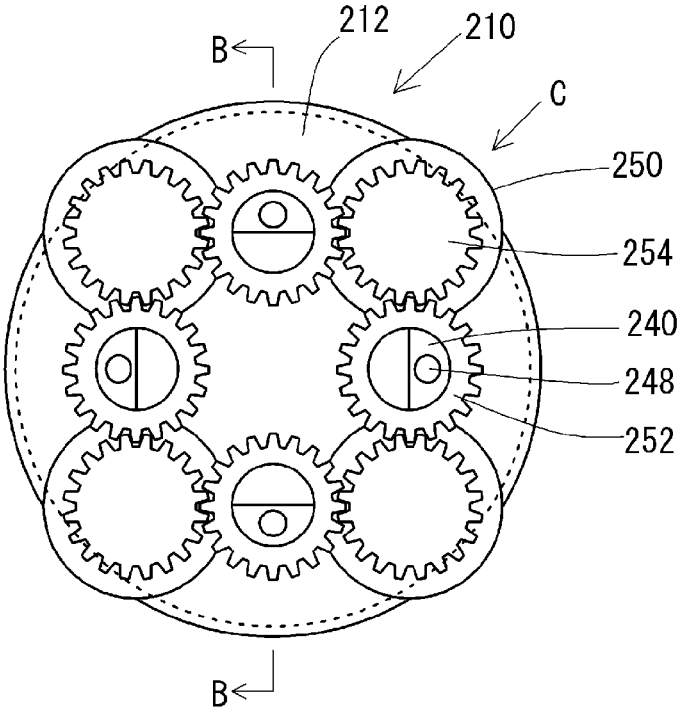
FIG. 11 is a diagram showing the nozzle device according to embodiment 3 as viewed from the spraying side.
Figure 12:
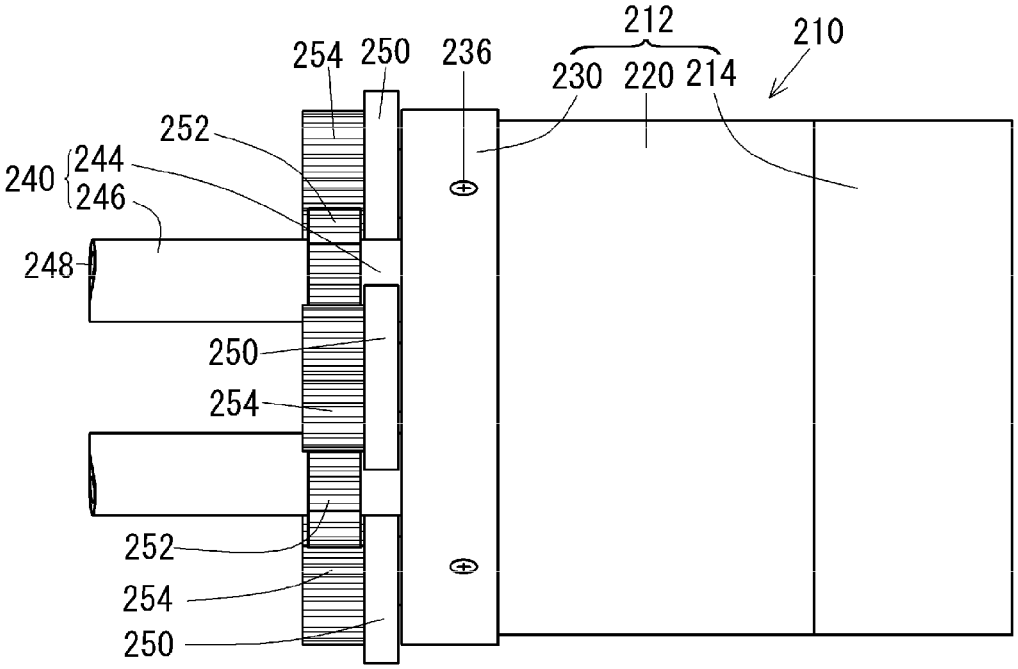
FIG. 12 is a side view of the nozzle device according to embodiment 3.

Referring to FIGS. 10 to 12, a nozzle device 210 according to embodiment 3 of the present invention will now be described. The nozzle device 210 is a multi-hole nozzle used for fire extinguishing work, and includes a body 212, rotational nozzles 240, and a dial 250. The dial 250 corresponds to the control member of the present invention.

FIG. 10 is a partial cross-sectional view showing the structure of the nozzle device 210. FIG. 11 is a front view of the nozzle device 210 as viewed from the spraying side. FIG. 10 shows a cross-section of the nozzle device 210 taken along line B-B in FIG. 11. In FIG. 10, rotational nozzles 240 and other parts at the back are not shown. FIG. 12 is a side view of the nozzle device 210 as viewed in the direction of arrow C in FIG. 11.

As shown in FIG. 10, the body 212 includes a front part 220, a water-supply pipe joint 214, hole members 224, and a front cover 230. The front part 220 is a tubular member that is closed on the spraying side, and has four insertion holes 222 in its surface on the same circumference on the spraying side. The hole members 224 are placed through the insertion holes 222. The axial direction of the insertion holes 222 is the same as the axial direction of the nozzle device 210. Each hole member 224 is a hollow member having a spray hole 228 in its center. A basal end portion 226 of each hole member 224 has a large diameter. Each hole member 224 is placed through the corresponding insertion hole 222 in the front part 220, and is fixed to the front part 220 with adhesive. A distal end of each hole member 224 then protrudes from the insertion hole 222 toward the spraying side.

The water-supply pipe joint 214 is a tubular member having the same outer diameter as the front part 220, and includes a water inlet portion 216, which has a female thread for connecting the water-supply pipe joint 214 to a water pipe by screwing. The water-supply pipe joint 214 and the front part 220 are integrated together by screwing. The front part 220, the hole member 224, and the water-supply pipe joint 214 that are integrated together correspond to a body part of the present invention. The front cover 230 corresponds to a lid of the present invention.

Each rotational nozzle 240 is a hollow member having a nozzle hole 248 in its center, and includes a base 244 on the water supply side, where the nozzle hole 248 has a larger diameter, and includes a flanged end, which serves as a seat 242, on the water supply side. A gear 252 is arranged at a short distance from each seat 242 on the spraying side. In a tip portion 246 of the rotational nozzle 240 on the spraying side, the axis of the nozzle hole 248 is tilted at an angle of 7 degrees relative to the axis of the rotational nozzle 240.

The front cover 230 is a disc-like part including a tubular portion 234, which extends on its outer circumferential portion. The tubular portion 234 is fixed on the outer circumference of the front part 220 with screws 236. The front cover 230 has a hole 232 at a position of its disc-like portion corresponding to the rotational nozzle 240. The hole 232 has a diameter larger than the diameter of the tip portion 246 and the base 244 of the rotational nozzle 240 and smaller than the diameter of the seat 242 of the rotational nozzle 240.

With its hole member 224 placed through the base 244 in which the nozzle hole 248 has a large diameter and its seat 242 arranged between the front part 220 and the front cover 230, the rotational nozzle 240 is retained in the body 212 in a rotatable manner.

As shown in FIGS. 11 and 12, four auxiliary gears 254, which are retained in the body 212 in a rotatable manner, are arranged on the surface of the body 212 on the spraying side, and are engaged with the gears 252 mounted on the rotational nozzle 240. The disc-like dial 250 is mounted on a shaft of each auxiliary gear 254. An outer circumferential portion of the dial 250 is knurled to prevent slipping. The dial 250 has an outer diameter portion protruding from the outer diameter of the body 212. The dial 250 may be arranged for one of the auxiliary gears 254.

The dial 250 is rotated to rotate the gears 252 via the auxiliary gears 254 to rotate the rotational nozzles 240. In embodiment 3, the auxiliary gears 254 and the gears 252 correspond to the rotation control mechanism.

The nozzle device 210 according to embodiment 3 includes the dial 250, which is rotated to rotate each rotational nozzle 240 to change the angle at which water is sprayed by the nozzle device 210. The mechanism for changing the spraying angle of the nozzle device 210 uses a simple operation to rotate the dial 250 to rotate the rotational nozzles 240, in each of which the axis z of the nozzle hole 248 in the tip portion 246 is tilted relative to the axis y, which is the rotation axis of the rotational nozzle 240. The nozzle device 210 thus includes fewer parts, and is easy to handle, and features high durability and easy maintenance. The pressure of water applied on the nozzle hole 248 of each rotational nozzle 240 acts in the direction to push the rotational nozzle 240 toward the spraying side in the direction of the axis y of the rotational nozzle 240. Thus, almost no such water pressure is applied in the direction of rotation of the dial 250, which is substantially perpendicular to the above spraying side direction. Although the pressure of water to be sprayed is high, the spraying angle of the water can be changed easily by rotating the dial 250 with small power.

In the structure of embodiment 3, the insertion holes 222 in the front part 220 may be tilted outwardly in the radial direction of the nozzle device 210, and the hole members 224 may be mounted obliquely to the body 212 to tilt the rotation axis of each rotational nozzle 240. In this case, the shafts of the auxiliary gears 254 may be tilted outwardly in the radial direction of the nozzle device 210 and mounted on the body 212, and the gears 252 and the auxiliary gears 254 may be beveled to have their diameters decreasing from the spraying side toward the water supply side. This allows smooth engagement between the gears.

The structure of embodiment 3 does not include the rotational ring covering the outer circumferential portion of the body. Thus, the body may not be cylindrical.

Embodiment 4

The control member and the rotation control mechanism in embodiments of the present invention may have structures other than those described in the above embodiments. A nozzle device 310 according to embodiment 4 including a lever as a control member will now be described with reference to FIGS. 13 to 15.

Figure 13:
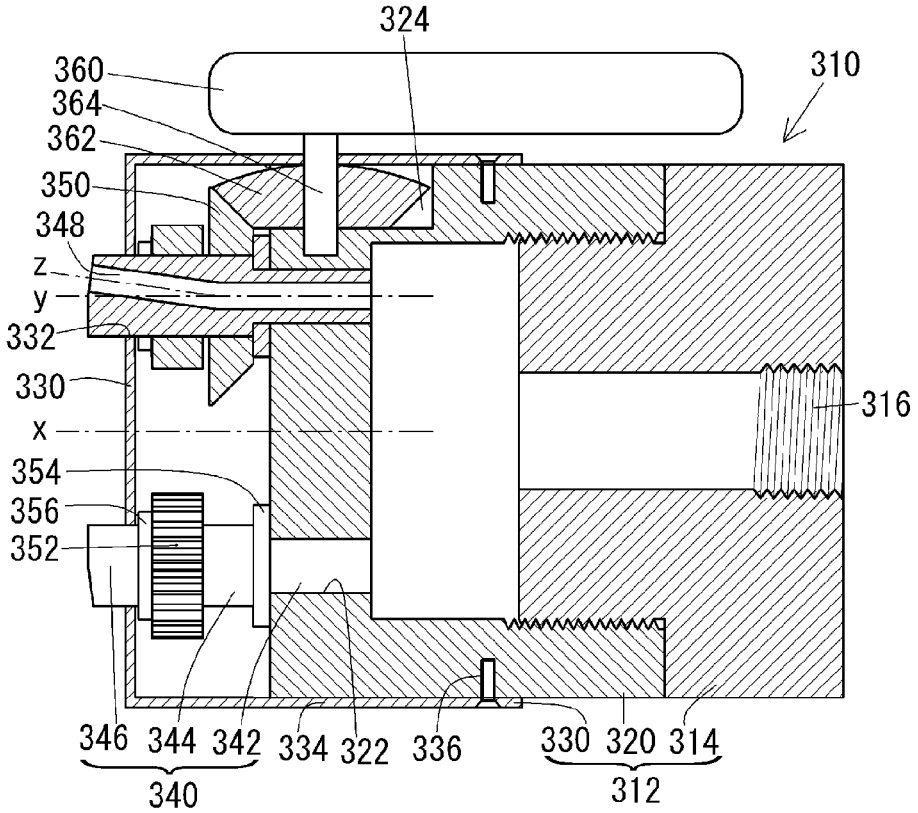
FIG. 13 is a partial cross-sectional view showing the structure of a nozzle device according to embodiment 4.

FIG. 13 is a partial cross-sectional view showing the structure of the nozzle device 310. The nozzle device 310 is a multi-hole nozzle used for fire extinguishing work, and includes a body 312, rotational nozzles 340, and a lever 360. The lever 360 corresponds to the control member of the present invention.

Figure 14:
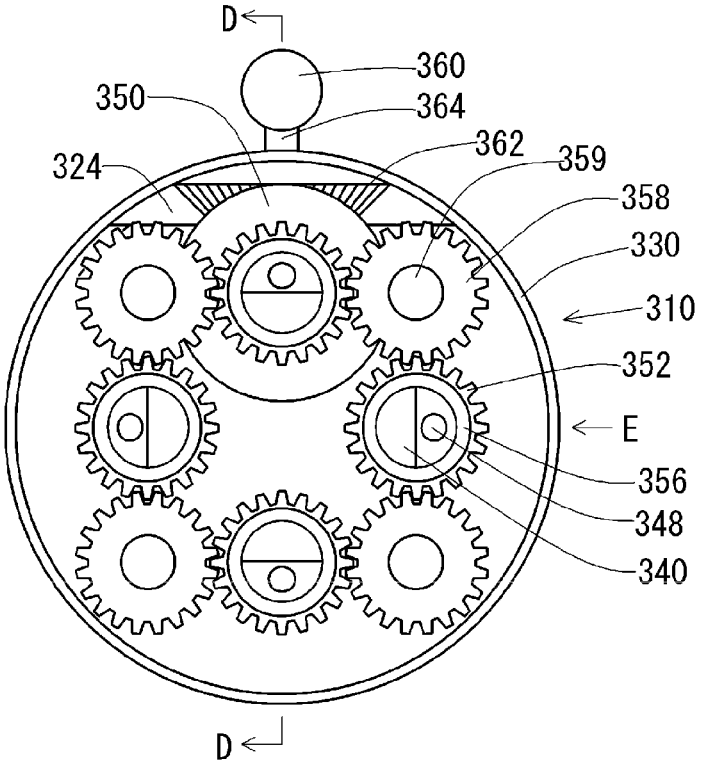
FIG. 14 is a perspective view of the nozzle device according to embodiment 4 as viewed from the spraying side.
Figure 15:
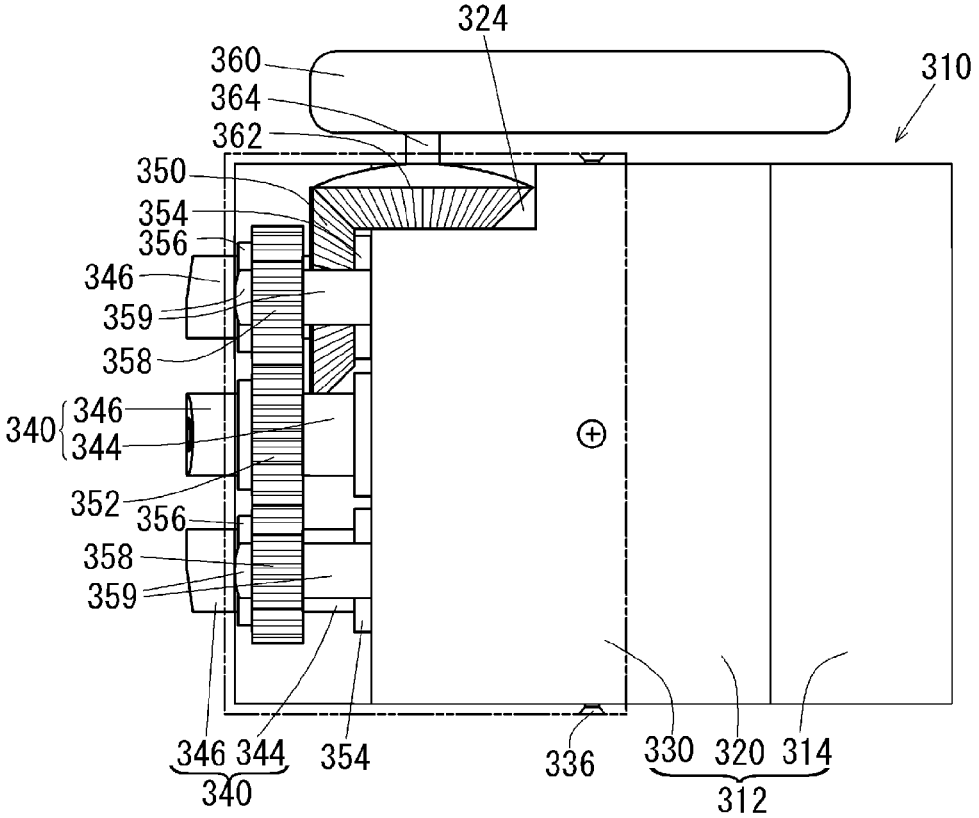
FIG. 15 is a side view of the nozzle device according to embodiment 4.

The body 312 includes a front part 320, a water-supply pipe joint 314, and a front cover 330. FIG. 14 is a front view of the nozzle device 310 as viewed from the spraying side through the front cover 330. FIG. 13 is a cross-sectional view taken along line D-D in FIG. 14. In FIG. 13, rotational nozzles 340 and other parts at the back are not shown. FIG. 15 is a side view of the nozzle device 310 as viewed through the front cover 330 in the direction of arrow E in FIG. 14.

The front part 320 is a tubular member that is closed on the spraying side, and has four spray holes 322 that extend in the axial direction of the nozzle device 310 in its surface on the same circumference on the spraying side. The axial direction of the spray holes 322 is the same as the axial direction of the nozzle device 310. The water-supply pipe joint 314 is a tubular member having the same outer diameter as the front part 320, and includes a water inlet portion 316, which has a female thread for connecting the water-supply pipe joint 314 to a water pipe by screwing. The water-supply pipe joint 314 and the front part 320 are integrated together by screwing. The front part 320 and the water-supply pipe joint 314 that are integrated together correspond to the body part of the present invention. The front cover 330 corresponds to the lid of the present invention.

Each rotational nozzle 340 is a hollow member having a nozzle hole 348 in its center, and includes a tip portion 346 on the spraying side, a base 344, and an insertion part 342 on the water supply side having a smaller outer diameter than the base 344. In a tip portion 346 of an end of the rotational nozzle 340 on the spraying side, the axis z of the nozzle hole 348 is tilted at an angle of 7 degrees relative to the axis y, which is the rotation axis of the rotational nozzle 340.

The front cover 330 is a tubular member that is closed on the spraying side, and has holes 332 each having a slightly larger diameter than the rotational nozzle 340 on its surface on the spraying side at a position corresponding to the rotational nozzle 340.

A lower spacer 354, which is disc-like and hollow, is placed on an end of the insertion part 342 of the rotational nozzle 340 on the side of the base 344. The insertion part 342 of the rotational nozzle 340 is placed in the spray hole 322 of the front part 320. A gear 352 is mounted at a short distance from the lower spacer 354 on the base 344 of the rotational nozzle 340. An upper spacer 356, which is disc-like and hollow, is placed on the gear 352 on the spraying side.

With the tip portion 346 of the rotational nozzle 340 protruding from the hole 332 in the front cover 330, a tubular portion 334 included in the front cover 330 is fixed on the outer circumference of the front part 320 with screws 336. With the lower spacer 354 and the upper spacer 356 arranged between the front part 320 and the front cover 330, the rotational nozzle 340 is retained in the body 312 in a rotatable manner.

Between the front part 320 and the front cover 330, four auxiliary shafts 359 are pivotally supported on the front part 320 in a rotatable manner. An auxiliary gear 358, which is engaged with two gears 352 mounted on the rotational nozzle 340, is mounted on each auxiliary shaft 359.

A bevel gear 350 for the rotational nozzle 340 is arranged between the lower spacer 354 and the gear 352 in one rotational nozzle 340. A bevel gear 362, which is engaged with the bevel gear 350, is arranged in a notch 324, which is a cutaway in an upper portion of the front part 320 on the spraying side.

The bevel gear 362 has a flat surface facing the front part 320, and has a spherical surface facing the front cover 330. The bevel gear 362 is fixed to a shaft 364, which is placed through a shaft hole in the notch 324 of the front part 320. The shaft 364 protrudes outside the front cover 330. The lever 360 is mounted on a tip portion of the shaft 364. The shaft 364 and the bevel gear 362 rotate integrally when the lever 360 is operated.

In the nozzle device 310, the bevel gear 362 for the lever 360 rotates when the lever 360 is operated. In cooperation with rotation of the bevel gear 362, the bevel gear 350 for the rotational nozzle 340 rotates. The gear 352 mounted on the rotational nozzle 340, which is coaxial with the bevel gear 350, then rotates the other rotational nozzle 340 via the auxiliary gear 358.

The nozzle device 310 includes the lever 360 as the control member, which is operated to rotate the plurality of rotational nozzles 340 at the same time to change the spraying angle of the nozzle device 310. The mechanism for changing the spraying angle uses a simple combination of gears for rotating the rotational nozzles 340. The nozzle device 310 thus includes fewer parts, and is easy to handle, and features high durability and easy maintenance. The pressure of water applied on the nozzle hole 348 in the tip portion 346 of each rotational nozzle 340 acts in the direction to push the rotational nozzle 340 toward the spraying side in the direction of the axis y of the rotational nozzle 340. Thus, almost no such water pressure affects the operation of the lever 360 for rotating the bevel gear 350 in the direction substantially perpendicular to the above spraying side direction. Although the pressure of water to be sprayed is high, the spraying angle of the water can be changed easily by operating the lever 360 with small power.

In the structure of embodiment 4, the spray holes 322 in the front part 320 may be tilted outwardly in the radial direction of the nozzle device 310, and the insertion part 342 of each rotational nozzle 340 may be placed in the corresponding spray hole 322 to tilt the rotation axis of each rotational nozzle 340.

The structure of embodiment 4 includes the lever as the control member, and does not include the rotational ring covering the outer circumferential portion of the body. Thus, the body may not be cylindrical.

Applicability for Fire Extinguishing Work

When the nozzle device according to the embodiments of the present invention is used for fire extinguishing work, the nozzle device for home use can be operated simply by connecting a hose from a water tap to the nozzle device.

When the control member is the rotational ring, the rotational ring can be rotated to adjust the water spraying range. This nozzle device allows fire extinguishing work to be performed efficiently in a wide range of area while maintaining a safe distance. The pressure of water applied on the nozzle hole of each rotational nozzle acts in the direction to push the rotational nozzle toward the spraying side in the direction of the axis of the rotational nozzle. Thus, almost no such water pressure is applied in the direction of rotation of the rotational ring, which is substantially perpendicular to the above spraying side direction. With the rotational ring rotatable with small power, this nozzle device is easy to use by old or young people, and can be effective in initial fire extinguishing.

In the nozzle device according to the embodiments of the present invention, the rotational ring that adjusts the water spraying range receives almost no water pressure as described above. The nozzle device with this structure is suitable for use as a fire extinguishing nozzle connected to an end of a hose for spraying water pressurized with, for example, a pump in a ladder truck for firefighting. The water spraying range can be changed in correspondence with the size of the area intended for fire extinguishing by rotating the rotational ring without changing the position at which fire extinguishing work is performed and without changing the orientation of the nozzle device. This reduces the burden on fire fighters and shortens the time taken for extinction of fires.

When the control member is the dial or the lever, the nozzle device according to the embodiments of the present invention, in which almost no water pressure affects the operation of the control member, can easily change the spraying angle.

Other Embodiments

To retain each rotational nozzle in the body, the retainer pin is used in embodiment 1, and the seat is arranged at the end of the rotational nozzle on the water supply side in embodiment 2. The rotational nozzles are arranged between the lid and the body in embodiments 3 and 4. Methods other than these may be used to retain each rotational nozzle in the body.

In embodiment 2, the spray hole 118 may have a cone shape that widens toward the water supply side, and the basal end part 123 of the rotational nozzle that internally touches the spray hole 118 may have a hollow cone shape that widens toward the water supply side. In this case, the seat 122 at the end of the basal end part 123 on the water supply side can be eliminated.

A portion corresponding to the seat 122 in embodiment 2 may have an outer diameter sized such that this portion can be placed through the spray hole 118, and may have a groove, in which a horseshoe ring may be fitted. This structure allows each rotational nozzle 120 to be placed into the spray hole 118 from the spraying side. Thus, the gear 128 and the rotational nozzle 120 may be integrated together. A horseshoe ring may then be fitted in a groove formed on a protrusion in the spray hole 118 on the water supply side to allow each rotational nozzle 120 to be retained in the body 112 in a rotatable manner.

Embodiments 1 and 2 each describe the case in which the axis y, which is the rotation axis of the rotational nozzle, is tilted outwardly in the radial direction relative to the axis x of the nozzle device in the spraying direction. Embodiments 3 and 4 each describe the case in which the axis y, which is the rotation axis of the rotational nozzle, is parallel to the axis x of the nozzle device. In some embodiments of the present invention, the axis y, which is the rotation axis of the rotational nozzle, may be tilted inwardly in the radial direction relative to the axis x of the nozzle device in the spraying direction. The axis y may be either parallel to the axis x or may be tilted outwardly or inwardly relative to the axis x. In any of these cases, the water spraying angle can be changed continuously when the axis z of the nozzle hole in the tip portion of the rotational nozzle is tilted relative to the axis y, which is the rotation axis of the rotational nozzle.

The axis y, which is the rotation axis of the rotational nozzle, may be tilted relative to the axis x of the nozzle device in the circumferential direction of the nozzle device. In this case, the water spraying angle can be changed continuously when the axis z of the nozzle hole in the tip portion of the rotational nozzle is tilted relative to the axis y, which is the rotation axis of the rotational nozzle.

To tilt the nozzle hole in the tip portion of the rotational nozzle relative to the rotation axis of the rotational nozzle in embodiments 1 and 2, the tip portion of the rotational nozzle is formed as a separate part, the hole tilted relative to the rotation axis of the rotational nozzle is formed in the protrusion included in the rotational nozzle, and the tip portion of the rotational nozzle is mounted in the hole. In embodiments 3 and 4, the rotational nozzle integrally includes the tip portion, and the nozzle hole in the tip portion of the rotational nozzle is tilted relative to the axis of the rotational nozzle. In some embodiments, the rotational nozzle may integrally include a hollow pipe as a tip portion, and the tip portion may be bent to tilt a nozzle hole in the tip portion relative to the rotation axis of the rotational nozzle.

The number of rotational nozzles is not limited to the numbers specified in the embodiments described above. When the nozzle device includes two or more rotational nozzles, the water spraying angle can be changed continuously. When the total area of the nozzle holes is the same, the nozzle device designed with a smaller number of rotational nozzles causes water sprayed from each rotational nozzle to travel a long distance but causes water jets sprayed from the rotational nozzles to have a wide interval between them at their destination, whereas the nozzle device designed with a larger number of rotational nozzles causes water sprayed from each rotational nozzle to travel a short distance but causes water jets sprayed from the rotational nozzles to have a narrow interval between them at their destination. Through experiments conducted using sequentially increasing numbers of rotational nozzles, the nozzle device may include seven rotational nozzles to maintain a good balance between the water traveling distance and the water jet interval at the destination.

In the nozzle device according to the embodiments of the present invention, the nozzle axis tilt angle determines the spraying angle. The spraying angle is larger as the nozzle axis tilt angle is larger. The nozzle hole tilt angle determines the change in the spraying angle. The change in the spraying angle is larger as the nozzle hole tilt angle is larger. The value of the nozzle axis tilt angle and the value of the nozzle hole tilt angle are not limited to those specified in the embodiments.

To spray water by adjusting the water spraying range for a target with a wide area at a long distance, the nozzle axis tilt angle may be not more than 10 degrees, and the nozzle hole tilt angle may be not more than 10 degrees. To spray water for a water spraying range with a wide area at an intermediate distance, the nozzle axis tilt angle and the nozzle hole tilt angle can be increased up to 20 degrees.

To spray water into a wider range, the nozzle axis tilt angle may be set to 20 degrees or more, and the nozzle hole tilt angle may be set to 20 degrees or more. To increase the nozzle axis tilt angle, for example, a rotational nozzle receiving part that is tilted steeply is arranged in a distal end of a nozzle hole, and the rotational nozzle may be placed into the rotational nozzle receiving part from the spraying side, and the rotational nozzle may be retained in the rotational nozzle receiving part at a position on the spraying side using a retainer pin. A bevel ring gear, which widens toward the spraying side, may be arranged on the inner circumferential surface of the rotational ring. The bevel ring gear may then be engaged with a gear on the protrusion of the rotational nozzle to allow the rotational nozzle with a large nozzle axis tilt angle to be rotatable. To increase the nozzle hole tilt angle, a pipe as a tip portion may be formed integrally with a rotational nozzle body, and then the tip portion may be bent, or a tip portion may be prepared separately from a rotational nozzle body and may then be adhered to the rotational nozzle body at an angle tilted relative to the body.

In the nozzle device 10 according to embodiment 1, the nozzle holes 46 in the tip portions 44 of all the rotational nozzles 30 are engaged with the gears 42 of the rotational nozzles 30 and the ring gear 54 of the rotational ring 50 at the rotational position where the nozzle holes 46 are oriented outwardly in the radial direction of the nozzle device 10. However, the engagement between the nozzle holes and the gears is not limited to this structure. The nozzle device 10 including the tip portion 44 of each rotational nozzle 30 oriented outwardly in the radial direction of the nozzle device 10 at different timing can also change the spraying angle.

In embodiment 1 described above, each of the rotational nozzles rotates at the same time by the same angle when the rotational ring is rotated, but the rotation angle of each rotational nozzle may not be the same. The nozzle device in which each rotational nozzle rotates by a different rotation angle can also change the spraying angle.

Although the above embodiments each describe the nozzle device used for fire extinguishing work, the nozzle device according to the embodiments of the present invention may also be used for other purposes, such as washing or sprinkling of water. The nozzle device according to the embodiments of the present invention may be used to spray fluids, including water, nonflammable gases, water containing air, gases containing powder or containing liquid particles, and liquids containing powder or bubbles.

In embodiments 1 and 2 described above, to increase the traveling distance of water, the tip portion of each rotational nozzle has the air hole, through which air is taken in to mix with water, and the water broken into water particles is accelerated and sprayed from the distal end of the nozzle hole. However, the air mixing with water caused a disturbance in the flow of the water particles, and the particles of water were dispersed when sprayed from the distal end of the nozzle hole. As a result, the traveling distance of water did not increase as expected. The distal end of the nozzle hole thus has the flow guide groove extending in the axis direction in the inner diameter portion to guide the flow of the water particles in the nozzle hole and to prevent such water particle dispersion from the nozzle hole.

Figure 16:
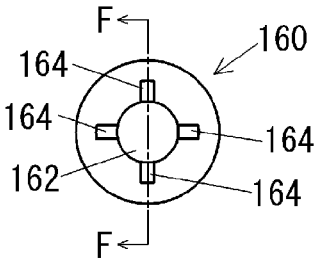
FIG. 16 is a front view of a tip portion of a rotational nozzle including flow guide grooves.
Figure 17:
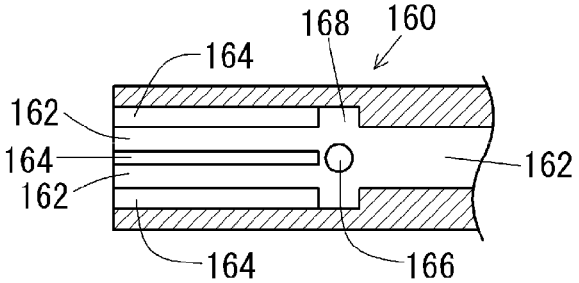
FIG. 17 is a cross-sectional view of the tip portion of the rotational nozzle including the flow guide grooves.

FIG. 16 is a front view of a tip portion of a rotational nozzle 160 including flow guide grooves 164 as viewed in the axis direction of a nozzle hole 162. FIG. 17 is a cross-sectional view taken along line F-F in FIG. 16, in which the axis direction of the nozzle hole 162 is horizontal. The rotational nozzle 160 includes a large-diameter part 168 having a larger diameter than the nozzle hole 162. The large-diameter part 168 has an air hole 166. On the spraying side from the air hole 166, four flow guide grooves 164 are arranged radially at equal intervals in the circumferential direction on the inner diameter portion of the nozzle hole 162. The flow guide grooves 164 extend in the axis direction of the nozzle hole 162 toward the distal end of the nozzle hole 162. The traveling distance of water is increased by forming the flow guide grooves 164 in the nozzle hole 162. To guide the flow of water, a plurality of flow guide plates may be arranged to extend in the axis direction on the inner diameter portion of the distal end of the nozzle hole 162.

The increase in the water traveling distance achieved by the flow guide grooves or flow guide plates arranged on the spraying side from the air hole may not be limited to the increase achieved by the rotational nozzles. The fixed nozzle arranged in the center in the radial direction in embodiments 1 and 2 may also have such an increase in the water traveling distance using flow guide grooves or flow guide plates.

The central nozzle case and the surrounding nozzle cases included in the nozzle device for extinguishing fires described in Patent Literature 1 above may also have the increase in the water traveling distance by providing flow guide plates or flow guide grooves on the inner diameter portion of the spray hole.

The nozzle device according to the embodiments of the present invention can change the spraying angle of each rotational nozzle at the same time by rotating the plurality of rotational nozzles, which include nozzle holes in their tip portions with the axis z tilted relative to the axis y as the rotation axis of the rotational nozzle. The nozzle device may have various structures other than the structures described in the above embodiments. For example, the control member may be a rotational ring, and the rotational nozzle may cover the hole member protruding from the body. The control member may be a lever, and the rotational nozzle may be retained in the body with a retainer pin.

The nozzle device according to the embodiments of the present invention may be implemented in various other forms without departing from the spirit and scope of the present invention.

REFERENCE SIGNS LIST

10 nozzle device
12 body
14 nozzle holder
16 spray hole
17 branch part
18 rotational nozzle receiving part
20 central spray hole
22 retainer pin
23 sealant ring
24 water-supply pipe joint
25 water inlet portion
26 O-ring
28 fixing screw
29 step portion
30 rotational nozzle
32 insertion part
34 engagement groove
36 protrusion
38 base
40 air hole
42 gear
43 cover retainer
44 tip portion
46 nozzle hole
48 fixed nozzle
50 rotational ring
52 case
54 ring gear
56 grip
57 fastener screw
60 stopper
61 auxiliary groove
62 guard
64 cover
65 nozzle receiving hole
66 air hole
70 spring
72 sphere
110 nozzle device
112 body
114 nozzle holder
116 water-supply pipe joint
117 water inlet
118 spray hole
119 central spray hole
120 rotational nozzle
122 seat
123 basal end part
124 base
125 protrusion
126 tip portion
127 air hole
128 gear
129 nozzle hole
130 rotational ring
132 ring gear
136 auxiliary ring
138 O-ring
140 fixed nozzle
142 C-ring

144 spacer
146 screw
148 gear
160 rotational nozzle
162 nozzle hole
164 flow guide groove
166 air hole
168 large-diameter part
180 nozzle device
181 body
182 rotational nozzle
183 pulley
184 timing belt
185 auxiliary pulley
186 roller
187 rotational ring
188 inner circumferential surface
190 nozzle device
191 body
192 rotational nozzle
193 gear
194 auxiliary gear
195 rotational ring
196 ring gear
210 nozzle device
212 body
214 water-supply pipe joint
216 water inlet
220 front part
222 insertion hole
224 hole member
226 basal end portion
228 spray hole
230 front cover
232 hole
234 tubular portion
236 screw
240 rotational nozzle
242 seat
244 base
246 tip portion
248 nozzle hole
250 dial
252 gear
254 auxiliary gear
310 nozzle device
312 body
314 water-supply pipe joint
316 water inlet
320 front part
322 spray hole
324 notch
330 front cover
332 hole
334 tubular portion
336 screw
340 rotational nozzle
342 insertion part
344 base
346 tip portion
348 nozzle hole
350 bevel gear
352 gear
354 lower spacer
356 upper spacer
358 auxiliary gear
359 auxiliary shaft
360 lever
362 bevel gear
364 shaft
a, b, c arrow (indicating water spraying direction)
x axis of nozzle device
y rotation axis of rotational nozzle
z axis of nozzle hole in tip portion of rotational nozzle

The invention claimed is:

1. A nozzle device for spraying fluid, comprising:
a body including a supply inlet that receives supply of fluid, and two or more spray holes that communicate with the supply inlet and are open on a fluid spraying side;
two or more rotational nozzles arranged in the body in correspondence with the two or more spray holes, the rotational nozzles being retained in the body in a rotatable manner; and
a control member that controls rotation of the rotational nozzles,
wherein
each rotational nozzle has a nozzle hole, through which fluid flowing into the corresponding spray hole of the body is sprayed toward a spraying side of the nozzle device,
each rotational nozzle includes a tip portion on the spraying side in which an axis of the nozzle hole is tilted relative to a rotation axis of the rotational nozzle, and
the nozzle device further comprises a rotation control mechanism that rotates each rotational nozzle based on an operation of the control member, and the rotation control mechanism is arranged between the control member and each rotational nozzle.

2. The nozzle device according to claim 1, wherein
the control member is a tubular rotational ring arranged around an outer circumferential portion of the body in a rotatable manner,
each rotational nozzle arranged in the body includes a protrusion that is placed through the corresponding spray hole and protrudes on the fluid spraying side,
each rotational nozzle includes a ring groove on an outer circumferential surface, and the ring groove receives a retainer pin protruding from a wall surface of the corresponding spray hole and extending inside the corresponding spray hole, and the retainer pin is engaged with the ring groove to retain the rotational nozzle in the body in a rotatable manner, and
the rotation control mechanism that rotates each rotational nozzle based on an operation to rotate the rotational ring is arranged between an inner circumferential surface of the rotational ring and the protrusion of each rotational nozzle facing the inner circumferential surface.

3. The nozzle device according to claim 1, wherein,
the body includes a body part including the spray holes and the supply inlet, and a lid including a hole through which each rotational nozzle is placed,
the control member is a dial arranged on a spraying side of the body,
each spray hole includes a tubular side wall and protrudes toward a spraying side of the body part,
each rotational nozzle is arranged in the body part such that the nozzle hole receives the side wall of the corresponding spray hole,
each rotational nozzle protrudes from the hole formed in the lid toward the spraying side of the body, an end of each rotational nozzle on a side of to the body is arranged between the lid that is fixed to the body part and the body part to retain the rotational nozzle in the body in a rotatable manner, and the rotation control mechanism that rotates each rotational nozzle based on an operation to rotate the dial is arranged between the dial and a protrusion of each rotational nozzle protruding from the lid.

4. The nozzle device according to claim 1, wherein the body includes a body part including the spray holes and the supply inlet, and a lid including a hole through which each rotational nozzle is placed, the control member is a lever arranged on an outer circumferential portion of the body, each rotational nozzle is arranged in the body part such that an end of each rotational nozzle on a side of the body part is placed in the corresponding spray hole, each rotational nozzle includes a tip portion protruding from the hole formed in the lid toward the spraying side of the body, each rotational nozzle is arranged between the lid that is fixed to the body part and the body part to retain the rotational nozzle in the body in a rotatable manner, and the rotation control mechanism that rotates each rotational nozzle based on an operation to change a direction of the lever is arranged between the lever and each rotational nozzle.

5. The nozzle device according to claim 1, wherein each rotational nozzle integrally includes the tip portion, and an axis of the tip portion is identical to the rotation axis of the rotational nozzle, and the nozzle hole in the tip portion is tilted relative to the rotation axis of the rotational nozzle.

6. The nozzle device according to claim 1, wherein the nozzle hole of each of all the rotational nozzles is tilted at a fixed angle relative to the rotation axis of each rotational nozzle.

7. The nozzle device according to claim 1, wherein each of the rotational nozzles arranged in the body in correspondence with the spray holes has the rotational axis that is parallel to an axis of the nozzle device in a spraying direction or is tilted toward the spraying side of the nozzle device away from a center of the nozzle device on the spraying side.

8. The nozzle device according to claim 1, wherein the rotation control mechanism is configured to rotate each of the rotational nozzles at the same time by the same angle, and the rotational nozzles are oriented such that the nozzle hole in the tip portion of each of the rotational nozzles is oriented most outwardly relative to a center of the nozzle device on the spraying side at the same time.

9. The nozzle device according to claim 8, wherein a tilt angle at which the rotation axis of each rotational nozzle is tilted relative to the axis of the nozzle device in a direction away from the center of the nozzle device on the spraying side is identical to a tilt angle at which the axis of the nozzle hole in the tip portion of each rotational nozzle is tilted relative to the rotation axis of the rotational nozzle.

10. The nozzle device according to claim 1, wherein each of the rotational nozzles arranged in the body in correspondence with the spray holes has the rotational axis that is tilted relative to an axis of the nozzle device in a spraying direction toward a center of the nozzle device on the spraying side.

11. The nozzle device according to claim 1, wherein the body includes a central spray hole that is open in a central portion of the body on the spraying side and communicates with the supply inlet inside the body.

12. The nozzle device according to claim 2, wherein the rotational nozzles are arranged on the same circumference in the body on the spraying side, the protrusion of each rotational nozzle includes a gear arranged in a base of the protrusion on a side of to the body, and the rotational ring includes a ring gear on an inner circumferential surface facing the gear, and the ring gear is engaged with the gear.

* * * * *